US008647245B2

(12) United States Patent
Casha

(10) Patent No.: US 8,647,245 B2
(45) **Date of Patent: *Feb. 11, 2014**

(54) SYSTEM FOR PASSIVE STRETCHING

(71) Applicant: Lawrence M. Casha, Andover, MA (US)

(72) Inventor: Lawrence M. Casha, Andover, MA (US)

(73) Assignee: Seign LLC, North Reading, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/652,153

(22) Filed: Oct. 15, 2012

(65) Prior Publication Data

US 2013/0035614 A1 Feb. 7, 2013

Related U.S. Application Data

(63) Continuation of application No. 12/704,968, filed on Feb. 12, 2010, now Pat. No. 8,313,420.

(60) Provisional application No. 61/152,447, filed on Feb. 13, 2009, provisional application No. 61/181,227, filed on May 26, 2009.

(51) Int. Cl.
*A63B 21/00* (2006.01)

(52) U.S. Cl.
USPC ..... 482/131; 482/142

(58) Field of Classification Search
USPC ..... 601/5; 482/4–5, 92, 121–125, 131–132, 482/142, 907
See application file for complete search history.

(56) References Cited

U.S. PATENT DOCUMENTS

| | | | | |
|---|---|---|---|---|
| 5,492,514 | A * | 2/1996 | Daum | 482/8 |
| 5,833,587 | A | 11/1998 | Strong et al. | |
| 6,422,983 | B1 | 7/2002 | Weck et al. | |
| 6,461,284 | B1 * | 10/2002 | Francavilla | 482/142 |
| 6,554,753 | B1 | 4/2003 | Weck et al. | |
| 6,575,885 | B1 | 6/2003 | Weck et al. | |
| 7,341,548 | B2 | 3/2008 | Heitzman | |
| 7,344,488 | B2 | 3/2008 | Weck et al. | |
| 7,494,446 | B2 | 2/2009 | Weck et al. | |
| 7,588,522 | B2 | 9/2009 | Heitzman | |
| 7,713,180 | B2 * | 5/2010 | Wickens et al. | 482/140 |
| 8,313,420 | B2 * | 11/2012 | Casha | 482/131 |
| 2003/0054927 | A1 | 3/2003 | Weck et al. | |
| 2005/0043155 | A1 | 2/2005 | Yannitte | |
| 2005/0107227 | A1 | 5/2005 | Massey | |

(Continued)

OTHER PUBLICATIONS

International Search Report for International Application No. PCT/US2010/024055, dated Oct. 12, 2010.

(Continued)

*Primary Examiner* — Theodore Stigell
(74) *Attorney, Agent, or Firm* — Morse, Barnes-Brown & Pendleton, P.C.; Sean D. Detweiler, Esq.

(57) ABSTRACT

A system for assisting in the performance of passive stretches includes a stretching device and a control mechanism. The stretching device includes an inflatable component. The control mechanism enables a user to control the degree of inflation of the inflatable component. The stretching device may optionally include one or more user contact surfaces attached to an outer layer or formed within an outer layer. The system may also include a support for supporting the stretching device at a particular height. The support may compressively hold the stretching device at the particular height when the inflatable component is inflated.

17 Claims, 31 Drawing Sheets

(56) References Cited

U.S. PATENT DOCUMENTS

| | | | | |
|---|---|---|---|---|
| 2005/0143234 | A1 | 6/2005 | Massey | |
| 2005/0261114 | A1 | 11/2005 | Heitzman | |
| 2008/0064579 | A1 | 3/2008 | Weck et al. | |
| 2008/0176727 | A1 | 7/2008 | Heitzman | |
| 2008/0188333 | A1* | 8/2008 | Tsai | 473/604 |
| 2010/0210977 | A1 | 8/2010 | Casha | |

OTHER PUBLICATIONS

International Preliminary Report on Patentability for International Application No. PCT/US2010/024055, dated Aug. 25, 2011.
Non-final Office Action for U.S. Appl. No. 12/704,968, mailed Jul. 24, 2012.
Notice of Allowance for U.S. Appl. No. 12/704,968, mailed Sep. 6, 2012.

* cited by examiner

SYSTEM FOR PASSIVE STRETCHING

RELATED APPLICATIONS

This application is a continuation of U.S. Pat. No. 8,313,420, issued Nov. 20, 2012, which claims priority to, and the benefit of, U.S. Provisional Application 61/152,447, filed Feb. 13, 2009, and U.S. Provisional Application 61/181,227, filed May 26, 2009, for all subject matter disclosed in said applications that is common to the present application. The disclosures of said applications are hereby incorporated by reference herein in their entirety.

FIELD OF THE INVENTION

The present invention relates to a stretching system that assists users in passively stretching body parts.

BACKGROUND OF THE INVENTION

Stretching is widely recognized to provide health benefits. For example, those who regularly stretch may experience more flexible muscles, a greater range of joint motion, improved blood circulation, stress relief, and increased balance and coordination. Increased flexibility, in turn, lowers one's risk of muscle, joint and tendon injuries. Improved blood circulation helps shorten recovery times for muscle injuries. As a result of the many benefits of stretching, stretching is a cornerstone of many physical therapy regimes.

One form of stretching is passive stretching, in which an external force is used to hold a body part in a position that stretches one's muscles. For those with limited mobility or injuries, passive stretching is more commonly performed with the assistance of a physical therapist that supports the individual's body parts and exerts force against the body part to stretch it.

Stretching provides the most benefits when performed regularly. Many factors may affect the frequency in which people engage in a passive stretching routine. For example, the inconvenience and cost of visiting a physical therapist may limit the number of sessions per week one engages in a stretching routine. In addition, many people suspend their physical therapy sessions when they travel. Furthermore, physical therapists may not be available or may be limited in number at some places.

SUMMARY

There is a need for a system that assists users in performing passive stretches without additional human assistance that is simple to use, portable, light, and accommodates different body sizes. The present invention is directed toward further solutions to address this need, in addition to having other desirable characteristics In accordance with one example embodiment of the present invention, a system for passive stretching includes a stretching device, the stretching device having an inflatable component affixed to a moveable platform. The inflatable component can be configured to apply force against a limb of a user placed thereon. A support can be provided supporting the stretching device, the stretching device being adjustably coupled to the support in such a way that the stretching device can be positionally adjusted along the support and fixed in a desired location. A first control mechanism can enable a user to control the degree of inflation of the inflatable component.

In accordance with aspects of the present invention, the inflatable component includes an inflatable inner core and an inflatable outer layer. A second control mechanism can be provided, enabling the user to control the degree of inflation of the inflatable component. At least one user contact surface can be provided in such a way that the user contact surface is positionally adjustable. The at least one user contact surface can be removably attached to the stretching device. The at least one user contact surface can be formed from a solid foam. The moveable platform can further include a pressure plate mounted thereon in such a way that pressure applied to the inflatable component impacts and is measurable by the pressure plate. The pressure plate can include a plurality of sensors that are configured to measure a force applied to the pressure plate. One or more mechanical fasteners can be configured to position or bind a limb of a user relative to the stretching device. A floor component can be coupled to the support, the floor component stabilizing the support when the system is in use. The system may be portable, and/or waterproof and submergible. A biofeedback component can include one or more user modules coupled to the user and one or more stretching device modules coupled to the stretching device, wherein the biofeedback component provides contemporaneous biological information to the user. The one or more stretching device modules can include a pressure sensor coupled to the stretching device to measure force applied to a body part in contact with the stretching device.

In accordance with one embodiment of the present invention, a method of using a device to assist in stretching a limb includes positioning an inflatable stretching device along a supportive frame in such a way as to be located in a desired position for implementation of a passive stretch of a limb of a user. The limb of the user is placed against the stretching device. Inflation of the inflatable stretching device is activated in such a way that a passive stretch of the limb is achieved.

In accordance with further aspects of the present invention, a pressure placed against the inflatable stretching device can be measured. An amount of inflation of the inflatable stretching device can be controlled based at least in part on a measurement of pressure placed against the inflatable stretching device by the limb of the user.

In accordance with one embodiment of the present invention, a system includes a stretching device having an inflatable component mounted on a movable platform. A first control mechanism can enable a user to control the degree of inflation of the inflatable component. A biofeedback component can be configured to provide contemporaneous biological information to the user.

In accordance with further aspects of the present invention, a pressure plate can be disposed on the movable platform in such a way as to sense force that is applied to the inflatable component. The biofeedback component can include one or more user modules and one or more device modules.

BRIEF DESCRIPTION OF THE FIGURES

These and other characteristics of the present invention will be more fully understood by reference to the following detailed description in conjunction with the attached drawings, in which.

DETAILED DESCRIPTION

Figure 1:
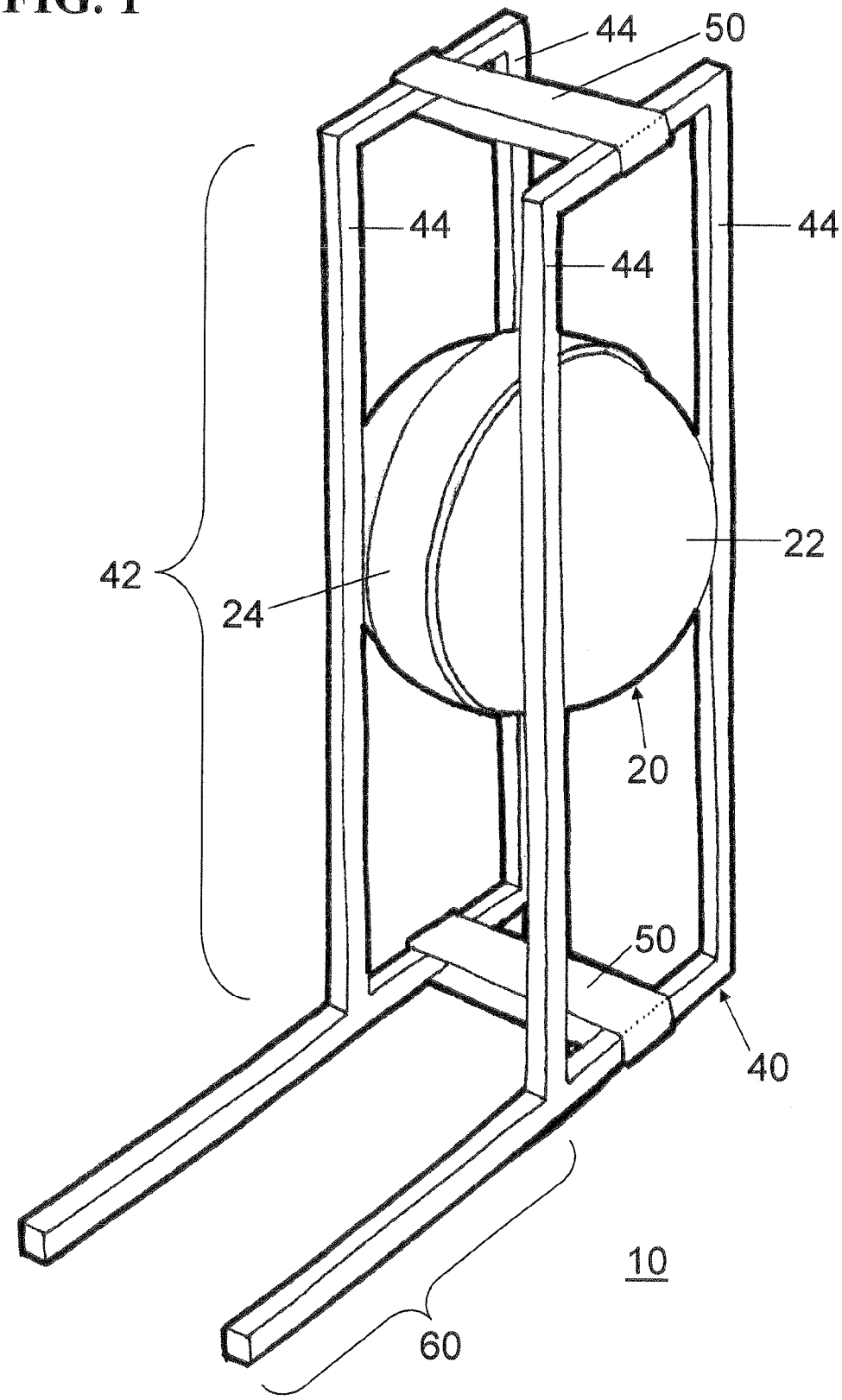
FIG. 1 is an illustration of a stretching system, in accordance with one example embodiment of the present invention.

An illustrative embodiment of the present invention relates to a device for assisting users in performing passive stretches. The device may be portable or alternatively, it may be removably attached to a support forming a stretching system. The stretching system includes a stretching device and a support, where the stretching device is positioned on the support, so that a surface for contacting the user is at the appropriate location for exerting force on a desired body part. The stretching device includes an inflatable member that can be a single inflatable component or be formed of an inflatable inner core and at least one inflatable outer layer, and is connected to a control mechanism that controls the inflation and deflation of one or more of the inflatable outer layer(s). The support holds the stretching device at a fixed height and orientation. The support may also include means for holding the stretching system in a fixed position relative to the user when the stretching system is in use.

FIGS. 1 through 27, wherein like parts are designated by like reference numerals throughout, illustrate example embodiments of a stretching system for assisting in the performance of passive stretches according to the present invention. Although the present invention will be described with reference to the example embodiments illustrated in the figures, it should be understood that many alternative forms can embody the present invention. One of ordinary skill in the art will additionally appreciate different ways to alter the parameters of the embodiments disclosed, such as the size, shape, or type of elements or materials, in a manner still in keeping with the spirit and scope of the present invention.

Turning now to a description of one example embodiment of the present invention, FIG. 1 shows a perspective view of a stretching system 10. The stretching system 10 includes a stretching device 20 held at a fixed height and orientation by a support 40. The stretching device 20 includes an inflatable inner core 22 that may be inflated to a size that can be held in place by the support 40, and at least one inflatable outer layer 24 that when inflated exerts pressure against an object that contacts its surface (such as a leg of a user). Again, the stretching device may likewise be formed of a single inflatable component, rather than inner and outer layers, as described later herein. The support 40 includes a frame 42 formed from bars 44 that compressively secures the stretching device 20 at the desired height and orientation due to a holding mechanism 50 when the inner core 22 is inflated. The support 40 may also include a floor component 60 to stabilize the support 40 and upon which the user may rest, so that the weight of the user keeps the support 40 in a fixed distance relative to the user.

The stretching device 20 may be formed of a number of different materials, including, but not limited to, poly vinyl chloride (PVC), vinyl, resin, vulcanized rubber, and flexible polymers. The inflatable inner core 22 is preferably formed in a spherical shape, but may be formed in any other shape, including, but not limited to a cylinder, a rectangular solid, and a hexagonal solid. The surface of the inflatable inner core 22 is preferably rough so that the inflatable outer layer 24 is less likely to slip relative to the inflatable inner core 22, but it may also be smooth. The roughness of the inflatable inner core 22 may be formed in many ways including, but not limited to, dimples, protrusions, or ridges formed in the material, or a rough coating applied to the exterior of the inflatable inner core 22. "Rough," as used herein, includes any surface property that increases the friction between two surfaces. Thus, for example, "rough" includes "sticky" or "tacky." The inflatable inner core 22 is of a size that, when positioned in the frame 42 and inflated, it can be held at a fixed height by the compression of the frame 42 of the support 40 against the inflatable inner core 22.

The stretching device 20 further includes at least one inflatable outer layer 24, which may be formed of the same or different material as the inflatable inner core 22. For example, the inflatable outer layer 24 may be made of rubber while the inflatable inner core 22 is made of PVC.

Furthermore, to the extent that the stretching device 20 is formed of a single component rather than an inner and outer inflatable layer, all of the above material properties and characteristics are likewise applicable to such an embodiment, as would be understood by one of ordinary skill in the art. Alternatively, the stretching device 20 may be formed of an inflatable inner layer and a non-inflatable outer layer that provides an interface for contact with the user. The non-inflatable outer layer may take on any of the described shapes and surface properties described herein.

Figure 2A:
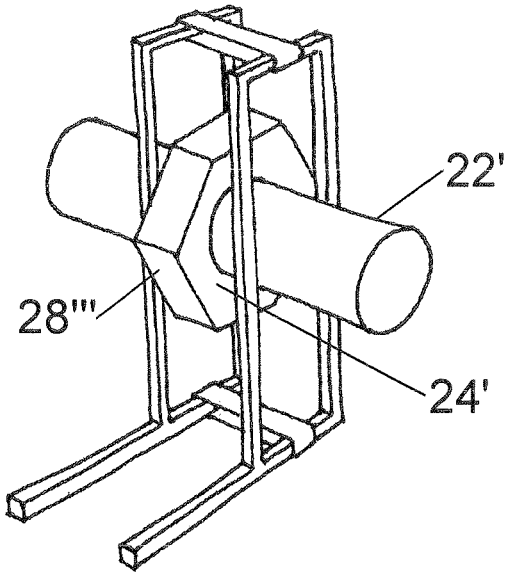
FIG. 2A is an illustration of the stretching system, in accordance with one example embodiment of the present invention.
Figure 2B:
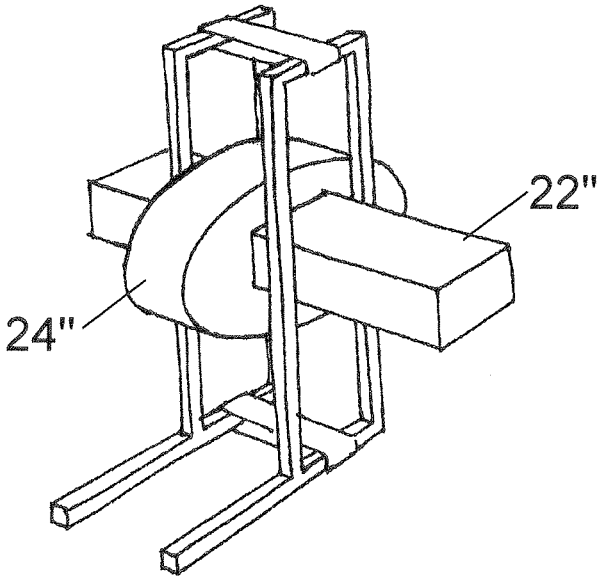
FIG. 2B is an illustration of the stretching system, in accordance with one example embodiment of the present invention.

FIGS. 1 and 2A-2B illustrate different embodiments of the stretching device 20 with one outer layer 24. In FIG. 1, the inflatable inner core 22 is spherical, whereas the inflatable outer layer 24 is tube shaped. In this embodiment, the inflatable outer layer 24 is positioned between the bars 44 of the frame 42, so that when the inflatable outer layer 24 is inflated, it does not intersect with the frame 42.

In FIG. 2A, the inflatable inner core 22' is cylindrical, and the inflatable outer layer 24' is tube shaped with an outer surface forming a hexagonal profile.

In FIG. 2B, the inflatable inner core 22" is a rectangular solid, and the inflatable outer layer 24" is tube shaped with an outer surface forming an oval profile. One of ordinary skill in the art will appreciate that additional material and shape configurations not specifically described herein are readily identifiable and fall within the scope of the present invention.

Figure 3A:
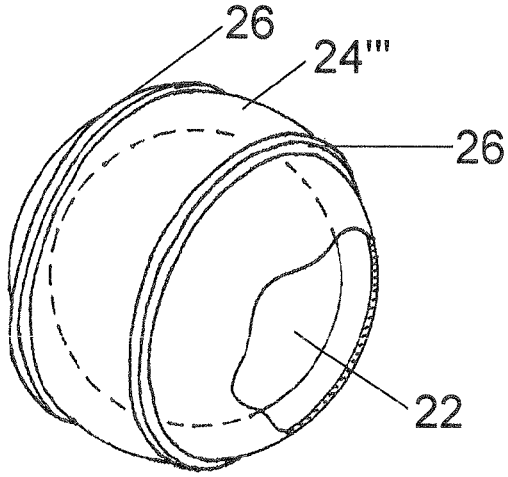
FIG. 3A is an illustration of a stretching device, in accordance with one example embodiment of the stretching system of the present invention, in which an outer layer of the stretching device entirely covers an inflatable inner core.
Figure 3B:
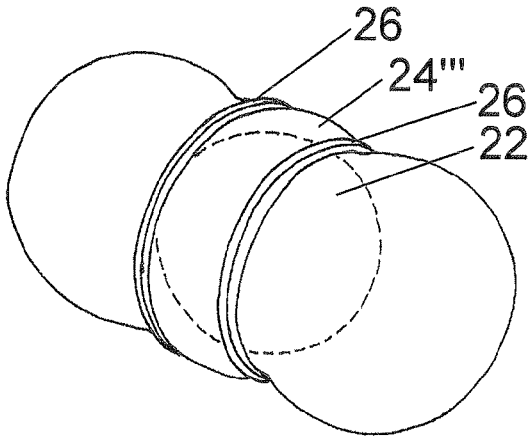
FIG. 3B is an illustration of the stretching device, in accordance with one example embodiment of the present invention, in which the outer layer is inflated and two bands are configured to prevent inflation in a portion of the outer layer between the two bands.
Figure 3C:
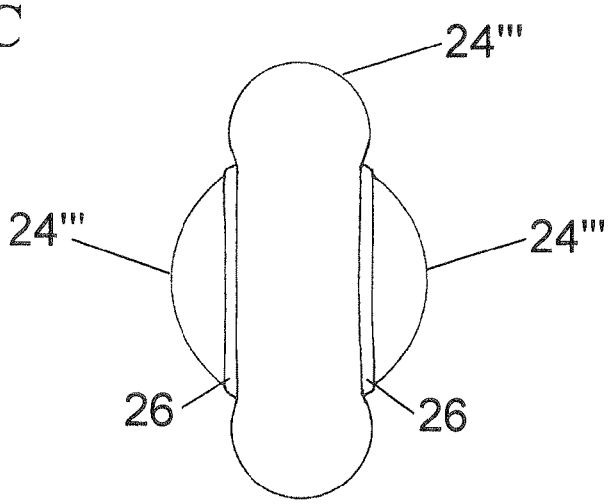
FIG. 3C is an illustration of the stretching device, in accordance with one example embodiment of the present invention, in which the outer layer is inflated and two bands are configured to prevent inflation of portions of the outer layer that is not between the two bands.

In FIGS. 3A-3C, an embodiment in which the inflatable outer layer 24''' entirely covers the inflatable inner core 22 is illustrated. In FIG. 3A, the inflatable inner core 22 and inflatable outer layer 24''' are both spherical. Two bands 26 are placed around the inflatable outer layer 24''' to help secure the inflatable outer layer 24''' to the inflatable inner core 22. The two bands 26 may also prevent one or more portions of the inflatable outer layer from expanding against the frame 42, which would interfere with the frame 42 holding the stretching device 20 at a desired height and orientation. For example, in FIG. 3B, the two bands 26 prevent a middle portion of the inflatable outer layer 24''' that is between the two bands 26 from expanding. Alternatively, as shown in FIG. 3C, the two bands 26 may prevent the outer portions of the inflatable outer layer 24''', that is, the portion that is not between the two bands 26, from expanding. The two bands 26 may be made of any suitable material that is able to withstand the pressures of the inflatable outer layer 24 being inflated. Additional bands may be used to define other patterns of regions to inflate or keep deflated without departing from the spirit and scope of the present invention.

Figure 4A:
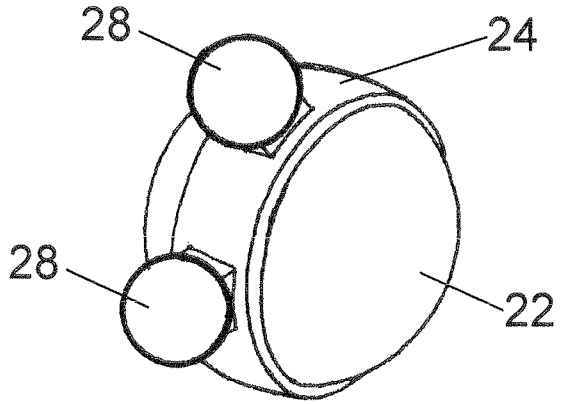
FIG. 4A is an illustration of the stretching device of the present invention with a first embodiment of a user contact surface.
Figure 4B:
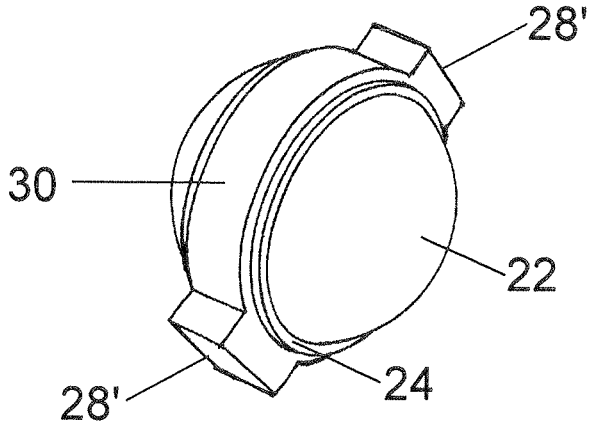
FIG. 4B is an illustration of the stretching device of the present invention with a second embodiment of a user contact surface.
Figure 4C:
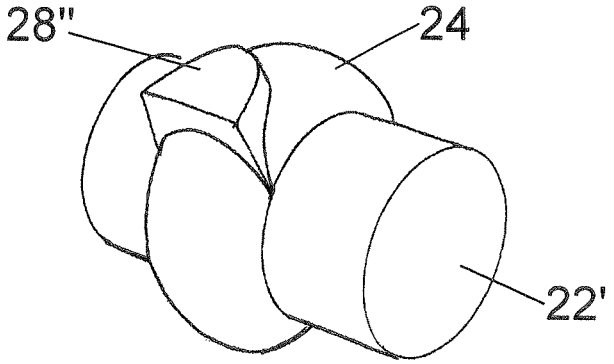
FIG. 4C is an illustration of the stretching device of the present invention with a third embodiment of a user contact surface.

In FIGS. 4A-4C, embodiments of the present invention that include a defined user contact surface are illustrated. While any part of the outer surface of the inflatable outer layer 24 may be used as a user contact surface, a specific user contact surface may be provided to increase the surface area that contacts the user. Such a user contact surface can be padded and pliant (e.g., foam) and may have any profile including that of a rectangular shape or a circular shape.

In FIG. 4A, two spherical user contact surfaces 28 are attached to the exterior surface of the inflatable outer layer 24. The user contact surfaces 28 may be permanently or removably attached to the inflatable outer layer 24. The user contact surfaces 28 may be formed of material, such as foam, and may be encased in a soft fabric covering to provide more comfort for the user. The user contact surfaces 28 may be made of any materials that can hold the desired shape for the user contact surface.

In FIG. 4B, two rectangular user contact surfaces 28' are formed within a second outer layer 30 that is positioned around the first outer layer 24, which may be inflatable. The second outer layer 30 may likewise be inflatable. The two user contact surfaces 28' are formed by filling portions of the second outer layer 30 with a material that holds its shape, for example, a special foam. The material may adhere to the inner surface of the second outer layer 30 or may be held in place in the second outer layer 30 due to the compressive forces exerted by the inner surfaces of the second outer layer 30. The second outer layer 30 may be attached to the first outer layer 24 using adhesives, or like materials, and/or the second outer layer 30 may stay in the same relative position to the first outer layer 24 through the friction between the two layers. User contact surfaces formed within an outer layer may be used with multiple intermediate outer layers or may be used with zero intermediate outer layers (i.e., formed within first outer layer 24).

In FIG. 4C, a single half-circle user contact surface 28" is formed within the surface of the first inflatable outer layer 24 and takes shape when the first inflatable outer layer 24 is partially inflated. Upon further inflation, the first inflatable outer layer 24 continues to inflate, but the user contact surface 28" maintains its shape.

While the user contact surface may protrude from a portion of the outer surface of an outer layer, as illustrated in FIGS. 4A-4C, the user contact surface may also be formed to cover the entire outer surface of an outer layer, such as the six user contact surfaces 28''' illustrated in FIG. 2A.

Figure 5A:
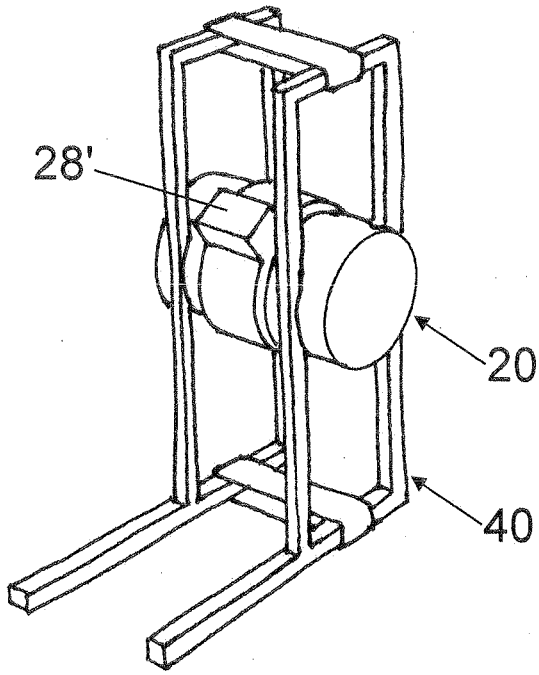
FIG. 5A is an illustration of the stretching device of the present invention held in a frame with a user contact surface pointing upward.
Figure 5B:
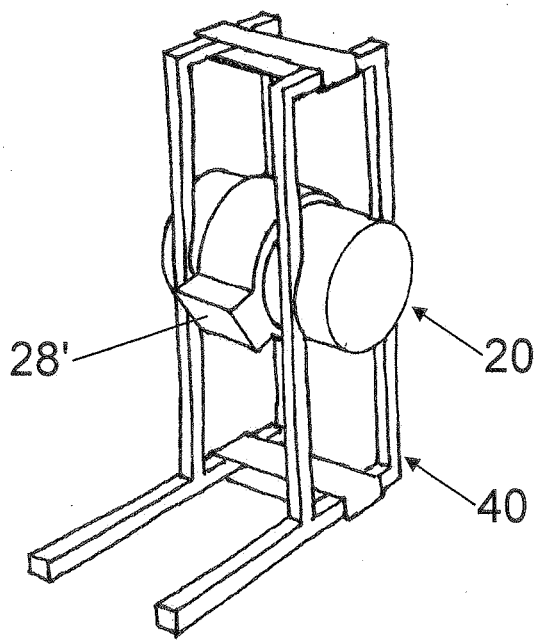
FIG. 5B is an illustration of the stretching device of the present invention held in a frame with a user contact surface pointing downward.

As illustrated in FIGS. 5A and 5B, the support 40 holds the stretching device 20 at a desired position. If the stretching device 20 includes defined user contact surfaces, the support 40 also holds the stretching device 20 with the one or more user contact surfaces 28 at a desired orientation. For example, in FIG. 5A, the support 40 holds the stretching device 20 with the user contact surface 28' facing upward. Alternatively, in FIG. 5B, the support 40 holds the stretching device 20 with the user contact surface 28' facing downward.

In FIG. 1, the support 40 includes a frame 42 that holds the stretching device 20 in place. The frame 42 includes vertical bars 44 which surround the stretching device 20 and hold the stretching device 20 in place when the inner core 22 is inflated a sufficient amount so that the bars 44 push against the stretching device 20, frictionally holding the stretching device 20 in place. The frame 42 may be made of any suitable material, including, but not limited to, aluminum and PVC. Preferably, the bars 44 are made of hollow aluminum tubes so that the frame 42 is light. Hollow aluminum tubes would also make the frame submergible, so that the stretching system may be used in wet environments. However, one of ordinary skill in the art will appreciate that a number of different materials will be suitable for different circumstances or environments.

Figure 6:
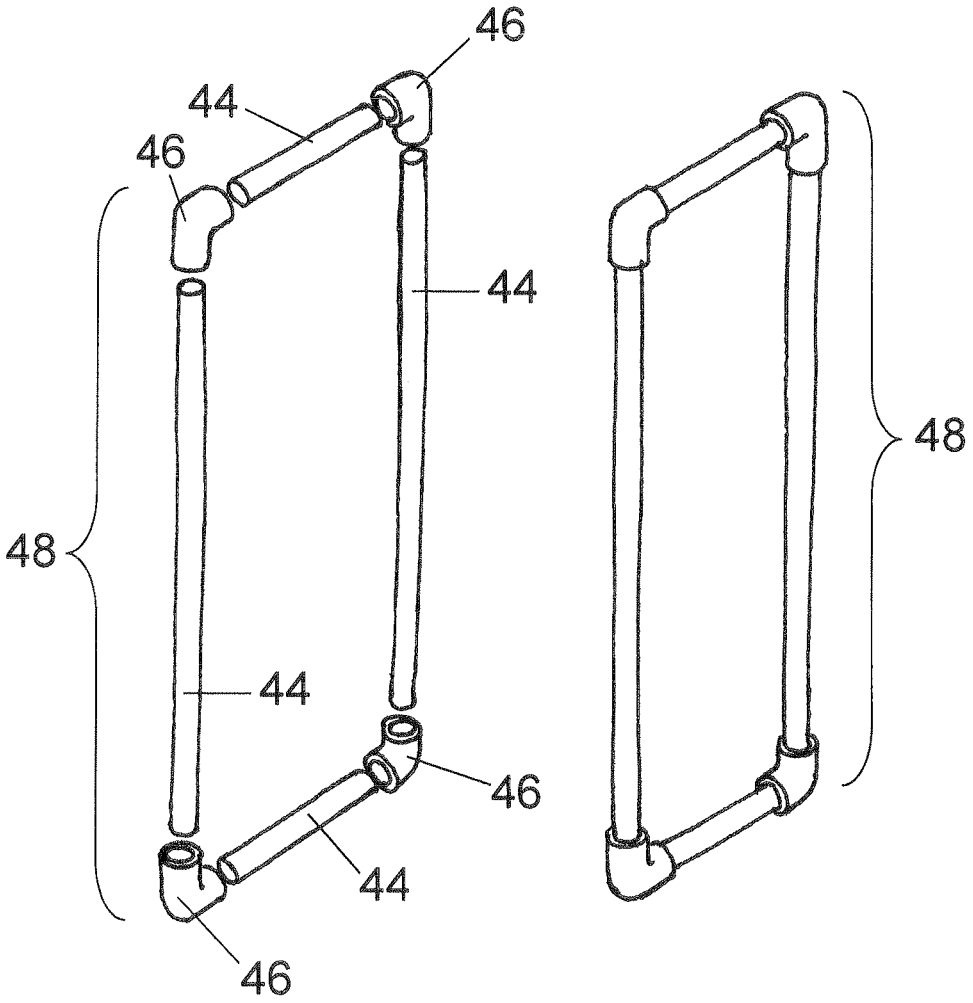
FIG. 6 is an illustration of two sub-frames that make up a frame of the present invention, in accordance with one example embodiment of the present invention.

As illustrated in FIG. 6, the frame 42 may be made of bars 44 joined by couplings 46. The couplings 46 may be removably attached to the tubes so that the frame may be disassembled. The bars 44 and couplings 46 form two rectangular sub-frames 48. As illustrated in FIG. 1, the two rectangular sub-frames 48 may be held together by elastic bands 50 at the top and bottom. The stretching device 20 is positioned within the cage formed by the four vertical bars 44 of the frame 42. The elastic bands 50 pull the two sub-frames 48 closer together and against the stretching device 20.

The bars 44 of the frame 42 may be also be welded together or removably attached using other mechanisms, including, but not limited to bolts or other mechanical fasteners. The bars 44 may be collapsible to enhance the portability of the device. Any of the sides of the frame 42 may include one or more bars 44.

Figure 7:
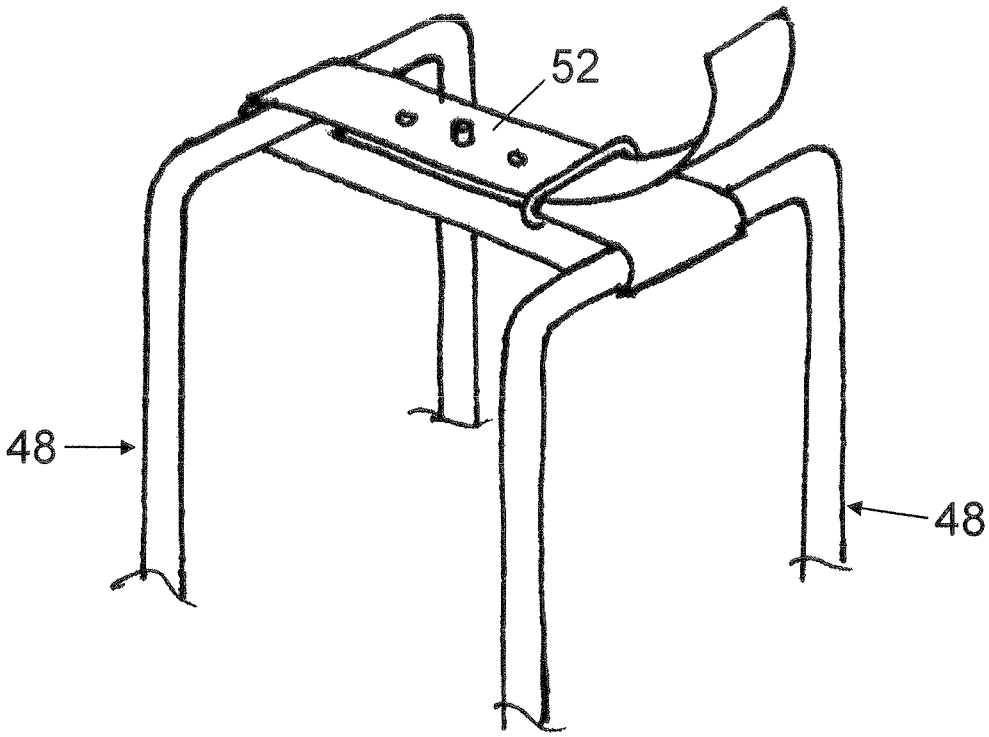
FIG. 7 is an illustration of a mechanism configured to hold the sub-frames of the frame together, in accordance with one example embodiment of the present invention.
Figure 8:
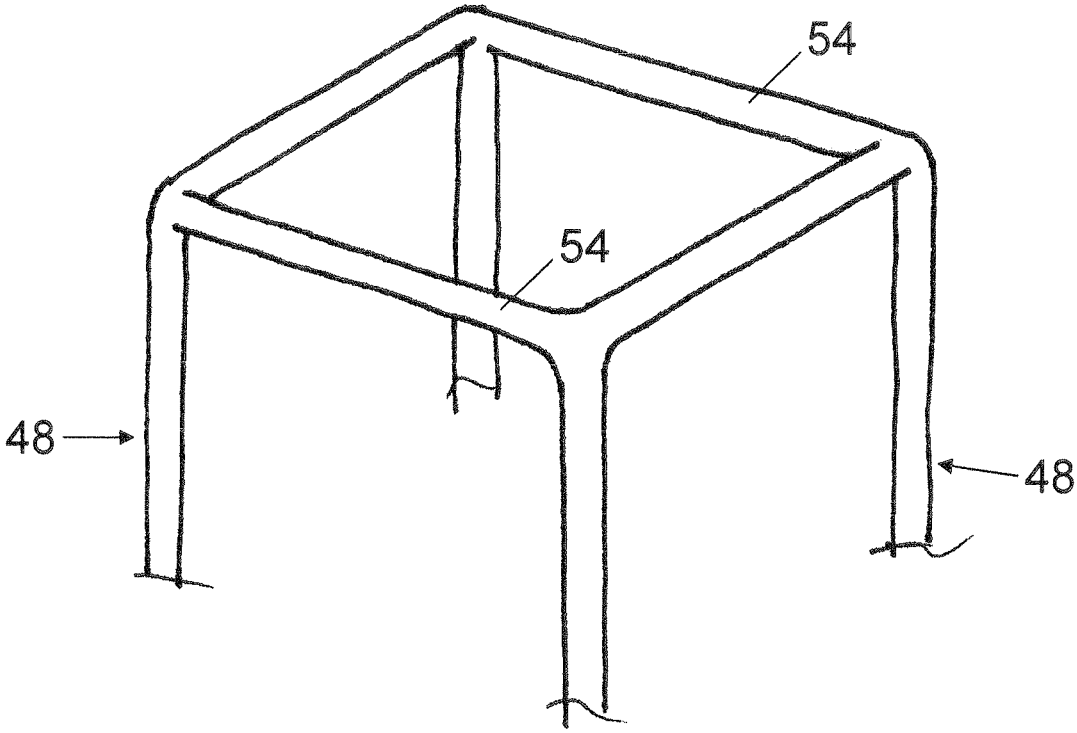
FIG. 8 is an illustration of the mechanism configured to hold the sub-frames of the frame together, in accordance with one example embodiment of the present invention.

As an alternative to elastic bands 50, the sub-frames 48 of the frame 42 may be held together by any material which is length adjustable, such as an adjustable strap 52, illustrated in FIG. 7. The sub-frames 48 may also be held at a fixed distance from each other by using bars 54, as illustrated in FIG. 8.

Figure 9:
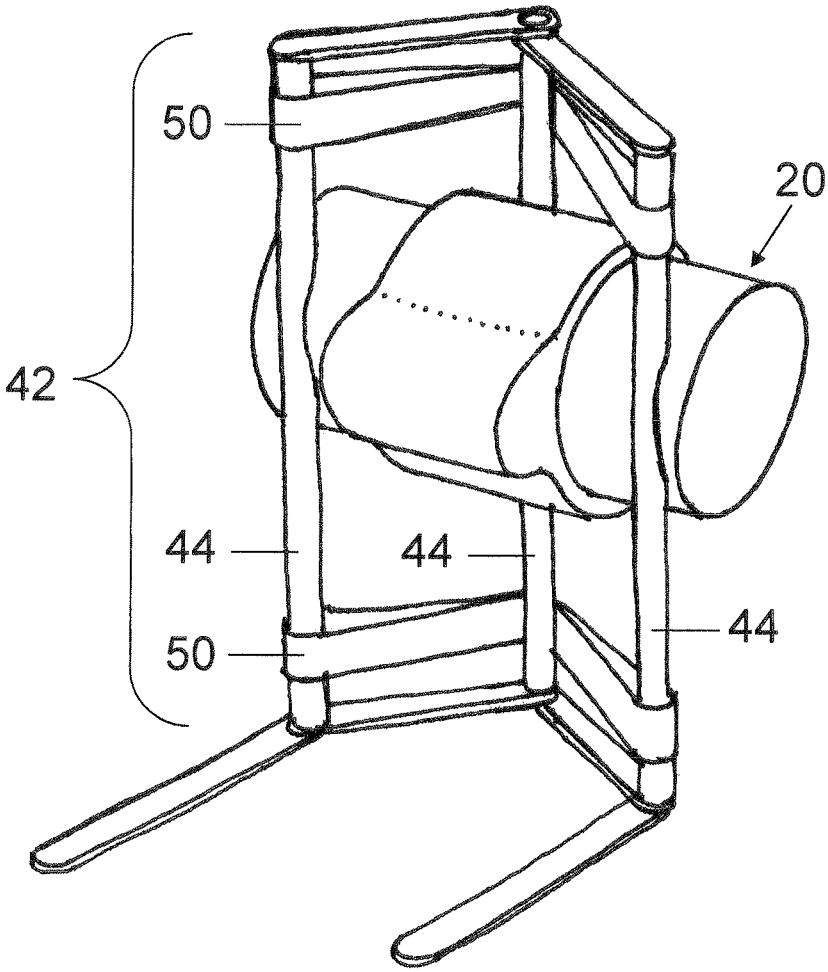
FIG. 9 is an illustration of the stretching system in which the frame includes three vertical bars, in accordance with one example embodiment of the present invention.
Figure 10:
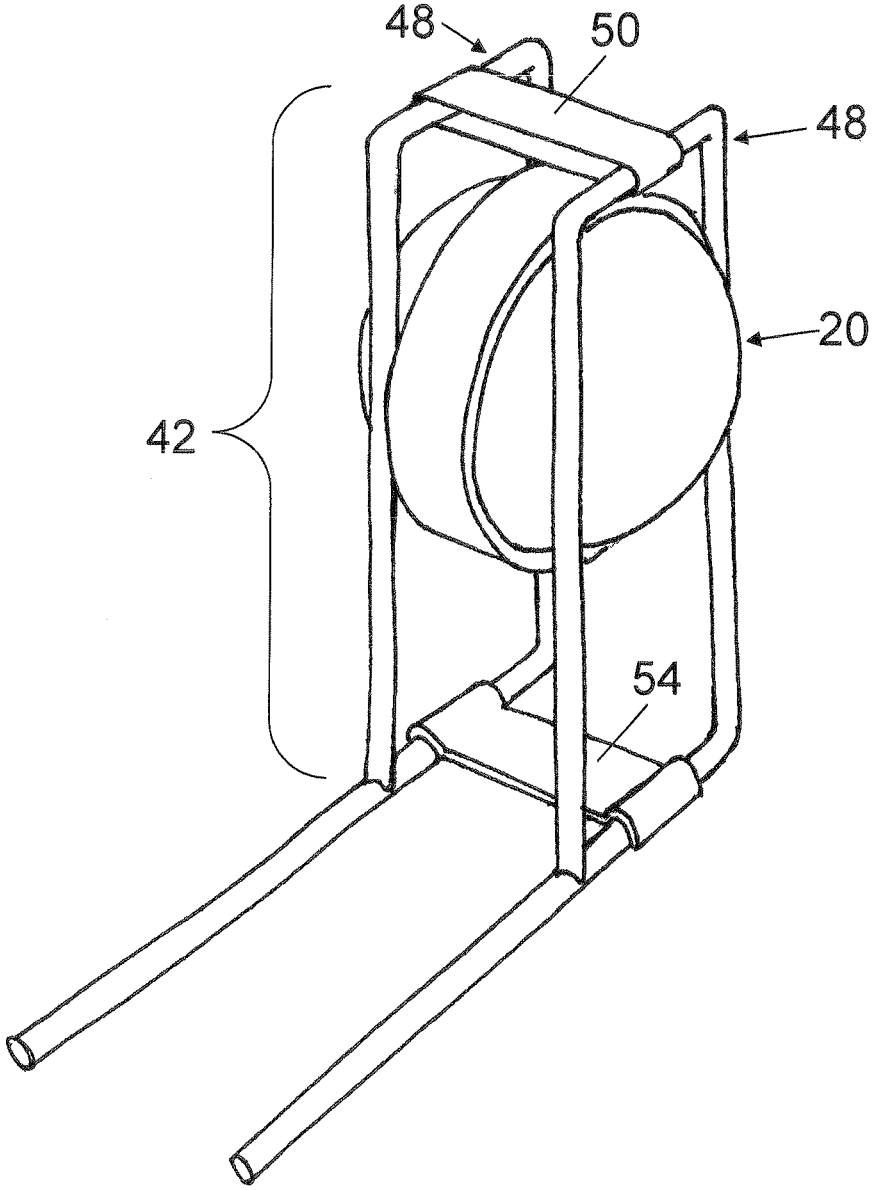
FIG. 10 is an illustration of the stretching system in which the frame includes a fixed size component at one end of the frame, in accordance with one example embodiment of the present invention.

While the frame 42 is illustrated with four vertical bars 44, a frame 42 with two or more vertical bars 44 may be used. For example, FIG. 9 illustrates a frame 42 with three vertical bars 44.

If the stretching device 20 is positioned at either end of the frame 42, a separator 54 may be placed between the sub-frames 48 at the opposite end to keep the sub-frames 48 positioned a fixed distance apart. For example, in FIG. 10, the stretching device 20 is placed at the top end of the frame 42 and a separator 54, illustrated as a strip with ends that wrap around the bars at the bottom of the frame, is placed at the bottom end of the frame 42. The separator 54 may be made of any suitable material and may be of any suitable shape and attached to the end of the frame 42 using any suitable means known to those of ordinary skill in the art.

Figure 11:
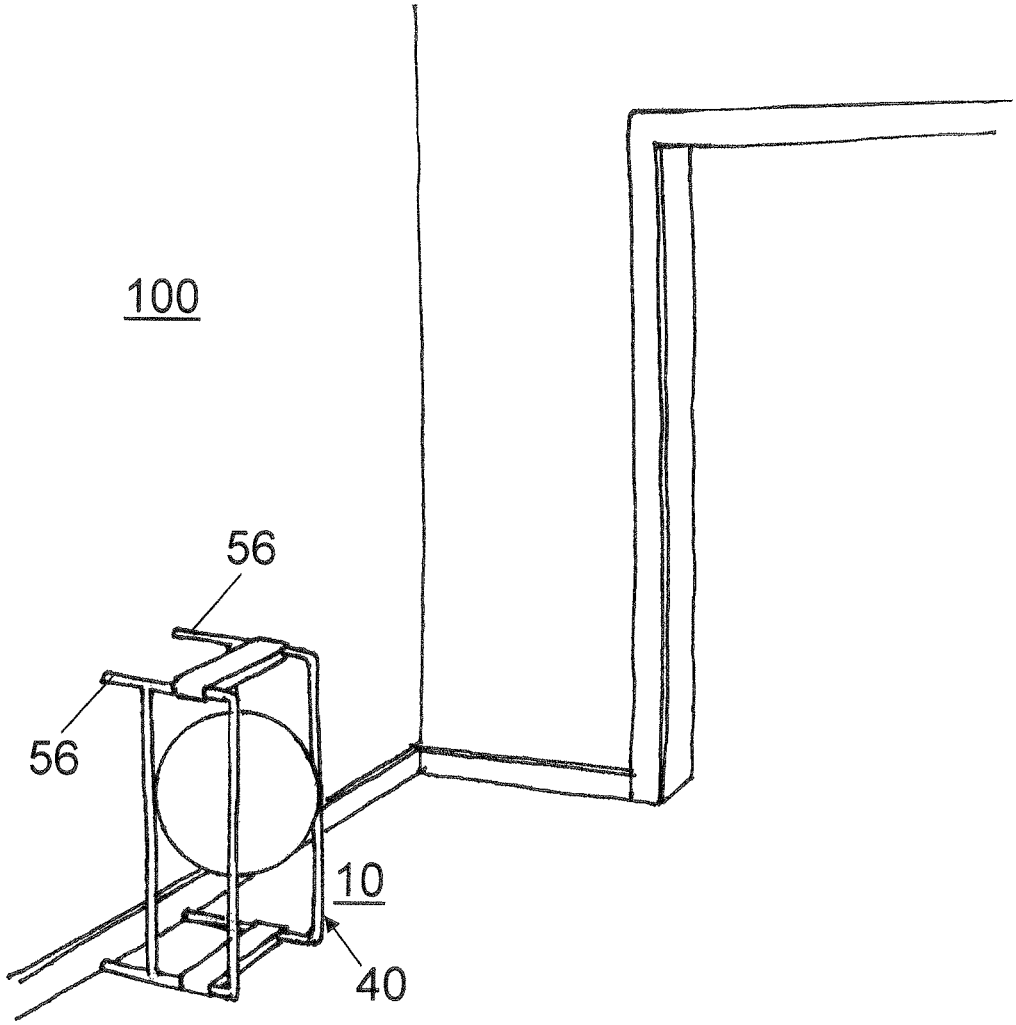
FIG. 11 is an illustration of the stretching system in which a support leans against a wall, in accordance with one example embodiment of the present invention.

Since the stretching system 10 exerts force on the user, it must be sufficiently stable to stay upright and in position while exerting force on the user. The stretching system 10 may be supported by leaning the support 40 against a wall 100, as illustrated in FIG. 11. For this situation, wall supports 56 attached to the frame 42 may be provided. The wall supports 56 may lean against the wall 100, or may be attached to the wall 100 using any suitable mechanisms.

Alternatively, the support 40 may include a floor component 60. As illustrated in FIG. 1, the floor component 60 may include two bars on which a user may rest, so that the frame is less likely to move away from the user when the stretching system 10 is used. The floor component 60 is preferably rigidly attached to the frame 42.

Figure 12A:
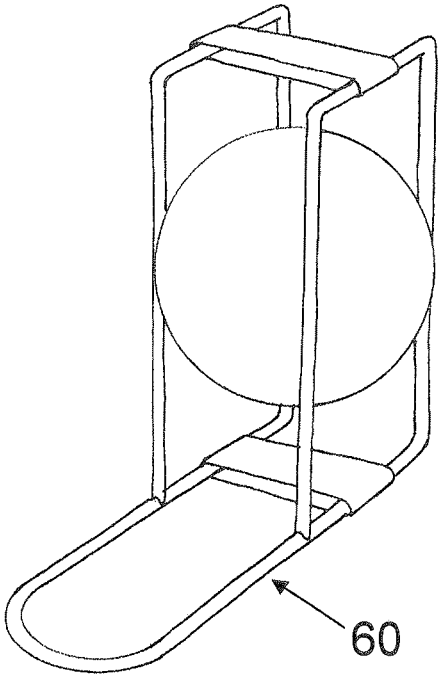
FIG. 12A is an illustration of the stretching system in which the support includes a curved bar floor component, in accordance with one example embodiment of the present invention.
Figure 12B:
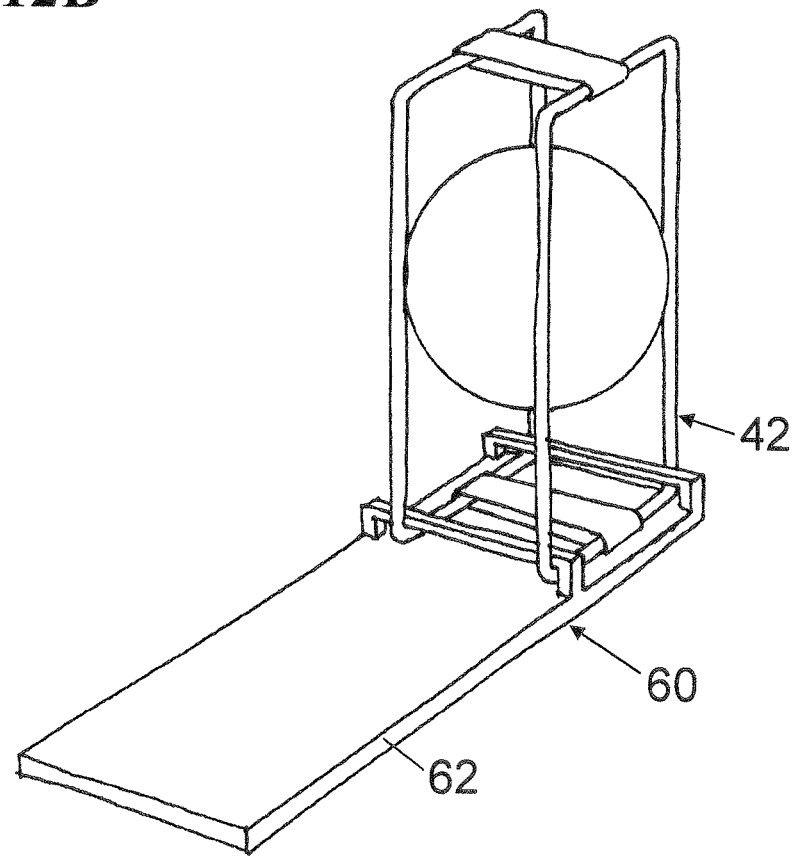
FIG. 12B is an illustration of the stretching system in which the support includes a floor component that is a platform, in accordance with one example embodiment of the present invention.

The floor component 60 may be of any size or shape, and may be made of any material which has sufficient rigidity to stabilize the stretching system 10. As illustrated in FIG. 12A, the floor component 60 may include a curved portion across which a user may rest. Alternatively, the floor component 60 may be formed by a platform 62 attached to the frame 42, as illustrated in FIG. 12B. The platform 62 may be made of any suitable material.

Figure 13B:
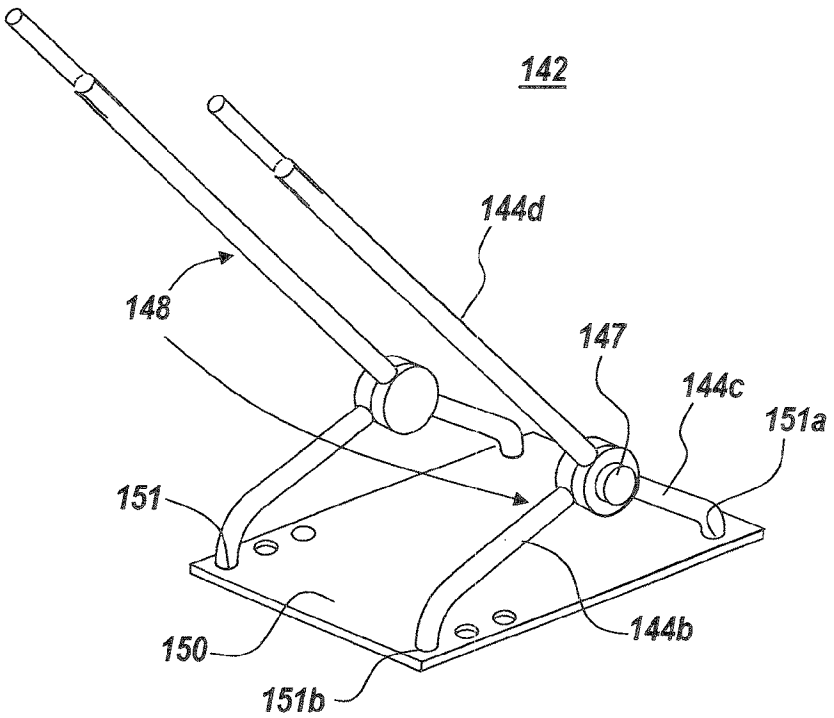
FIG. 13B is an illustration of a support formed of a triangular frame in accordance with one example embodiment of the present invention.
Figure 13A:
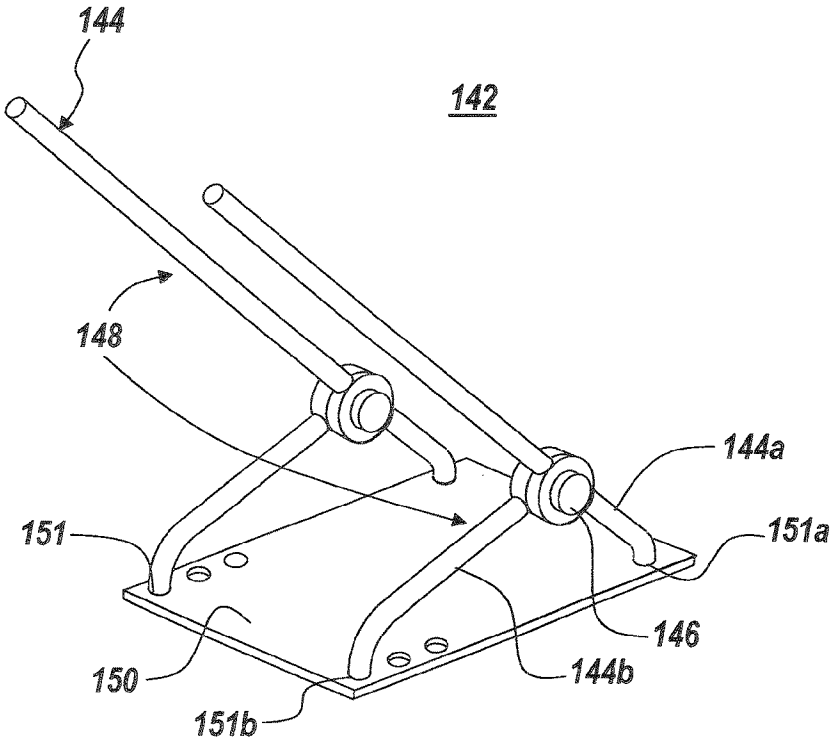
FIG. 13A is an illustration of a support formed of a triangular frame in accordance with one example embodiment of the present invention.
Figure 13D:
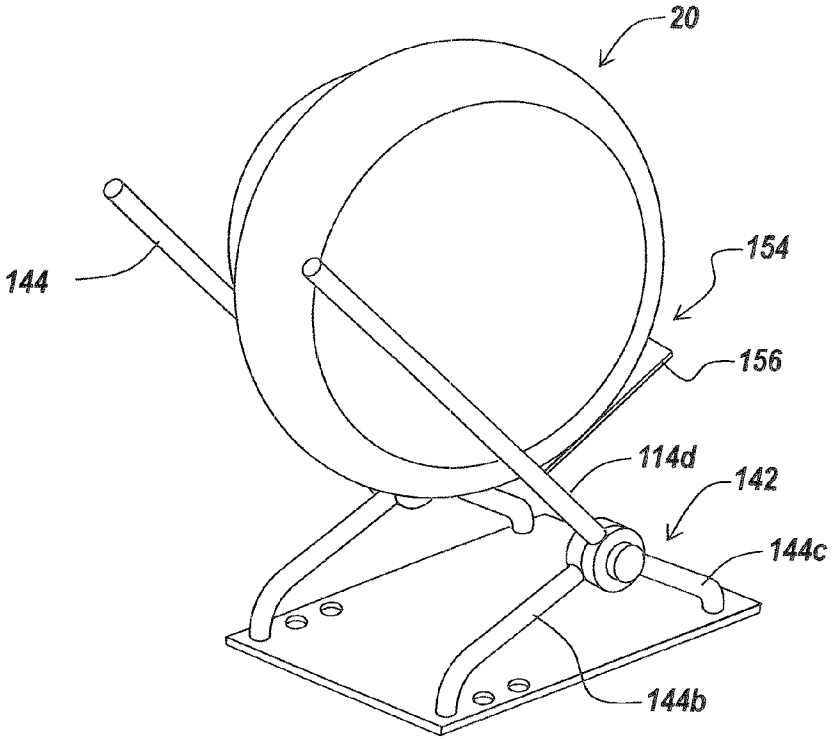
FIG. 13D is an illustration of the stretching device of the present invention held in the triangular frame.
Figure 13C:
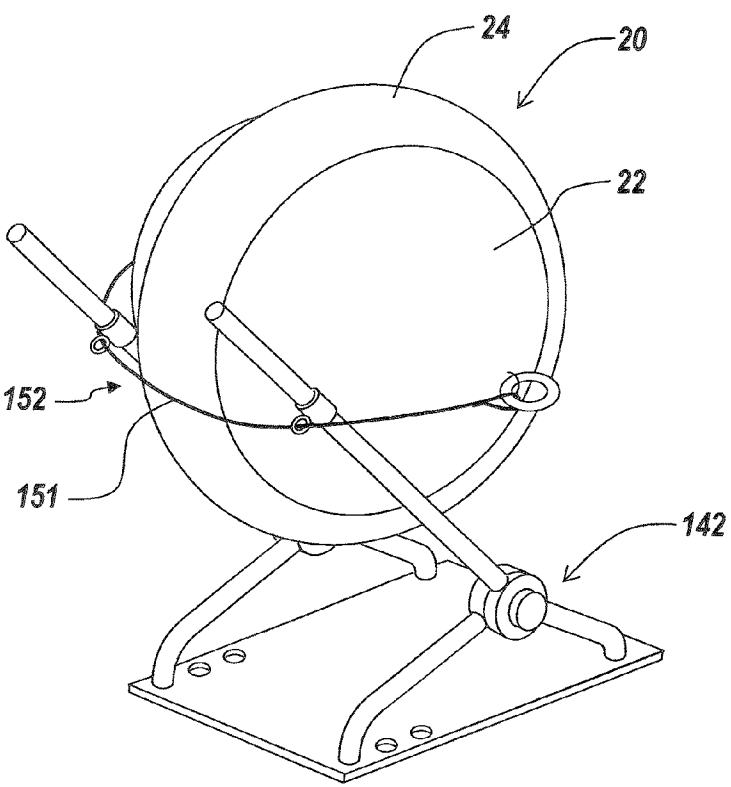
FIG. 13C is an illustration of the stretching device of the present invention held in the triangular frame.

In the exemplary embodiment of the stretching system 10 illustrated in FIG. 13A, the support is in the form of a triangular frame 142 that holds the stretching device 20 in place (see also FIG. 13C). The triangular frame 142 includes at least two triangular sub-frames 148 that are coupled to a platform 150. Alternatively, the sub-frames 148 may be coupled together by one or more horizontal connecting legs (not shown). The platform 150 or the horizontal legs may be rigid and removably or permanently attached to the triangular sub-frames 148. Alternatively, the platform 150 or the horizontal legs may be flexible and allow adjustment of the distance between the two triangular sub-frames 148. In addition, the platform 150 may include a plurality of connection nodes 151 on each side of the platform 150 where the triangular sub-frames 148 may be removably attached.

As illustrated in exemplary embodiment illustrated in FIG. 13A, each triangular sub-frame 148 can be formed of two bars 144*a* and 144*b* coupled together by a coupling 146. Alternatively, as illustrated in FIG. 13B, the bar 144*a* can be formed of two bars 144*c* and 144*d* such that the triangular sub-frame 148 is formed of bars 144*b*, 144*c* and 144*d* joined by a three-way coupling 147. The couplings 146 and 147 may be removably attached to the bars 144*a*-144*d* so that the triangular frame 142 may be disassembled. Alternatively, the bars 144*a*-144*d* may be welded together or removably attached using other mechanisms, including, but not limited to bolts or other mechanical fasteners. The bars 144*a*-144*d* may be collapsible to enhance the portability of the device. As further illustrated in FIG. 13B, the bars 144 may also be telescoping bars that have adjustable lengths.

According to an example embodiment of the present invention, the bar 144*a* or the bar 144*c* may be permanently attached to an attachment node 151*a* provided on the platform 150. The bar 144*b* may be removably attached to an attachment node 151*b* provided on the platform 150. By modifying the location of the bar 144*b*, the user may adjust the inclination of the bar 144*a* or 144*b*.

The stretching device 20 may be coupled to the triangular frame 142 using an attachment mechanism 152. As illustrated in FIG. 13C, the attachment mechanism 152 may be a rope or a belt 151 that is permanently or removably coupled to the stretching device 20. The attachment mechanism 152 may also be permanently or removably coupled to the triangular frame 142. When the attachment mechanism 152 is coupled to both the stretching device 20 and the triangular frame 142, the attachment mechanism 152 securely couples the stretching device 20 to the triangular frame 142.

Alternatively, as illustrated in FIG. 13D, the stretching device 20 may be coupled to the triangular frame 142 using a stand mechanism 154. The stand mechanism 154 may include one or more shelves 156 attached to the bar 144*d* facing the user. Alternatively, the stand mechanism 154 may also include one or more shelves 156 attached to the bar 144*d* facing away (not shown) from the user. An angle between the shelves 156 and the bars 144*a* or 144*d* may be 90° or less. According to an example embodiment of the present invention, the one or more shelves 156 may be collapsible so that the triangular frame 142 occupies minimal space when not in use.

Similar to the frame 42, the triangular frame 142 may be made of any suitable material, including, but not limited to, aluminum, composite and PVC. Preferably, the bars 144*a*-144*d* are made of lightweight materials so that the triangular frame 142 is easily portable. Hollow aluminum tubes would also make the triangular frame 142 submergible, so that the stretching system 10 may be used in wet environments. However, one of ordinary skill in the art will appreciate that a number of different materials will be suitable for different circumstances or environments.

Figure 14A:
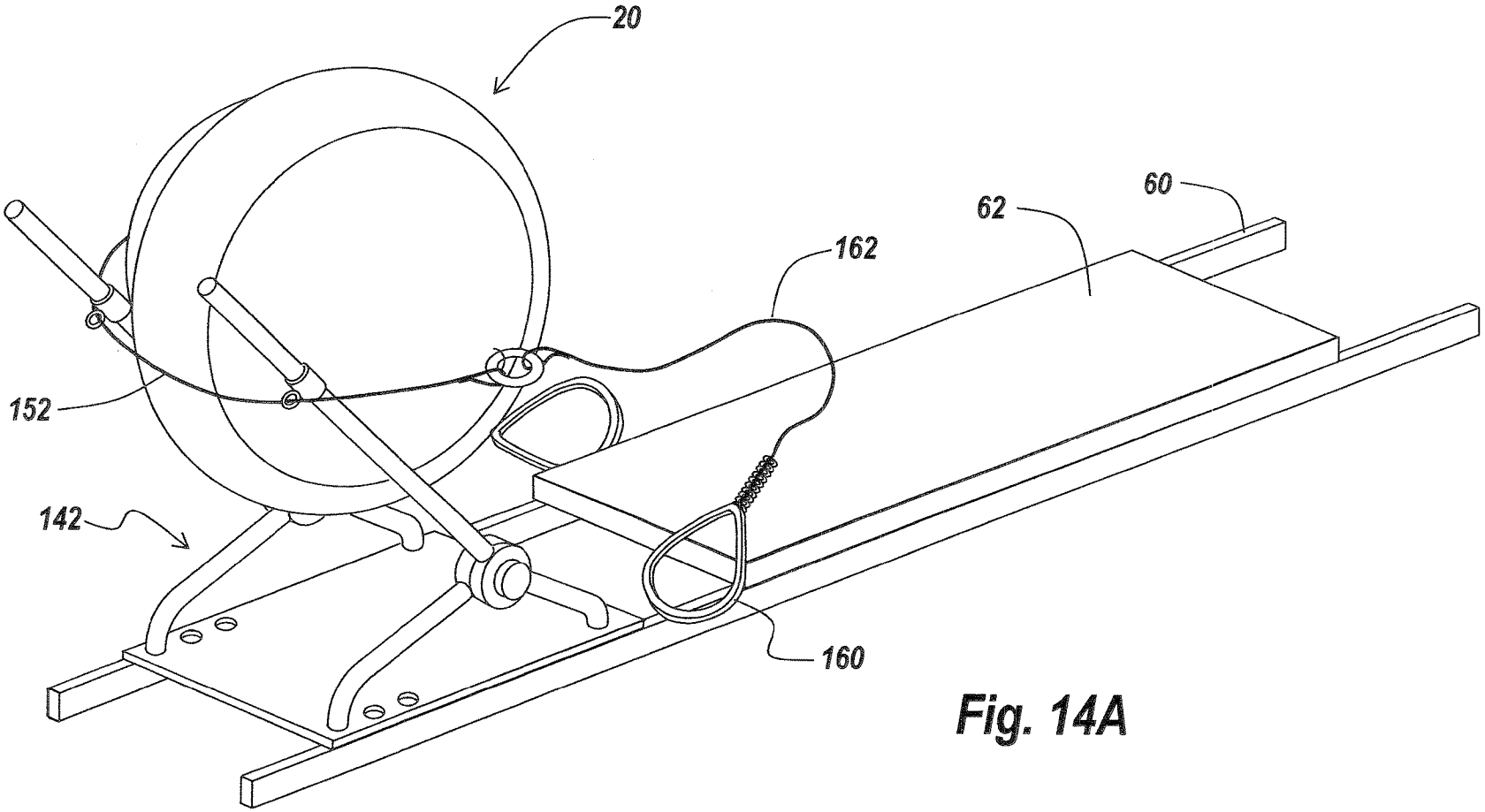
FIG. 14A is an illustration of the stretching system in which the triangular frame includes a floor component that is a platform, in accordance with one example embodiment of the present invention.
Figure 14B:
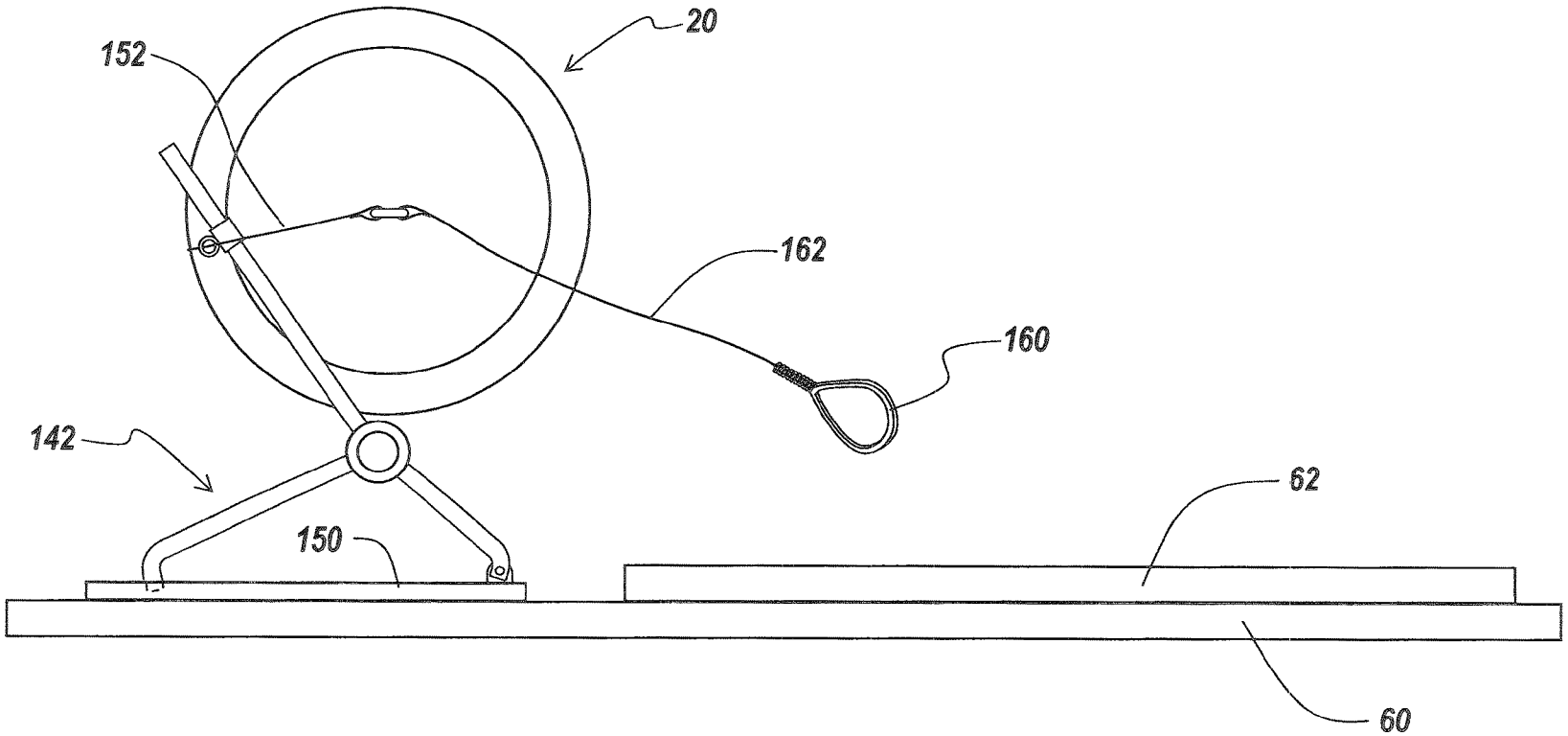
FIG. 14B illustrates a side view of the stretching system in which the triangular frame includes the platform as illustrated in FIG. 14A.

The support 40 with the triangular frame 142 may also include a floor component 60. As illustrated in FIGS. 14A-14B, the floor component 60 may include two bars and a platform 62 on which a user may rest, so that the frame is less likely to move away from the user when the stretching system 10 is used. The platform 62 may be made of any suitable material. A mat may be provided on the platform 62 for increased user comfort. The floor component 60 is preferably rigidly attached to the triangular frame 142.

Figure 15A:
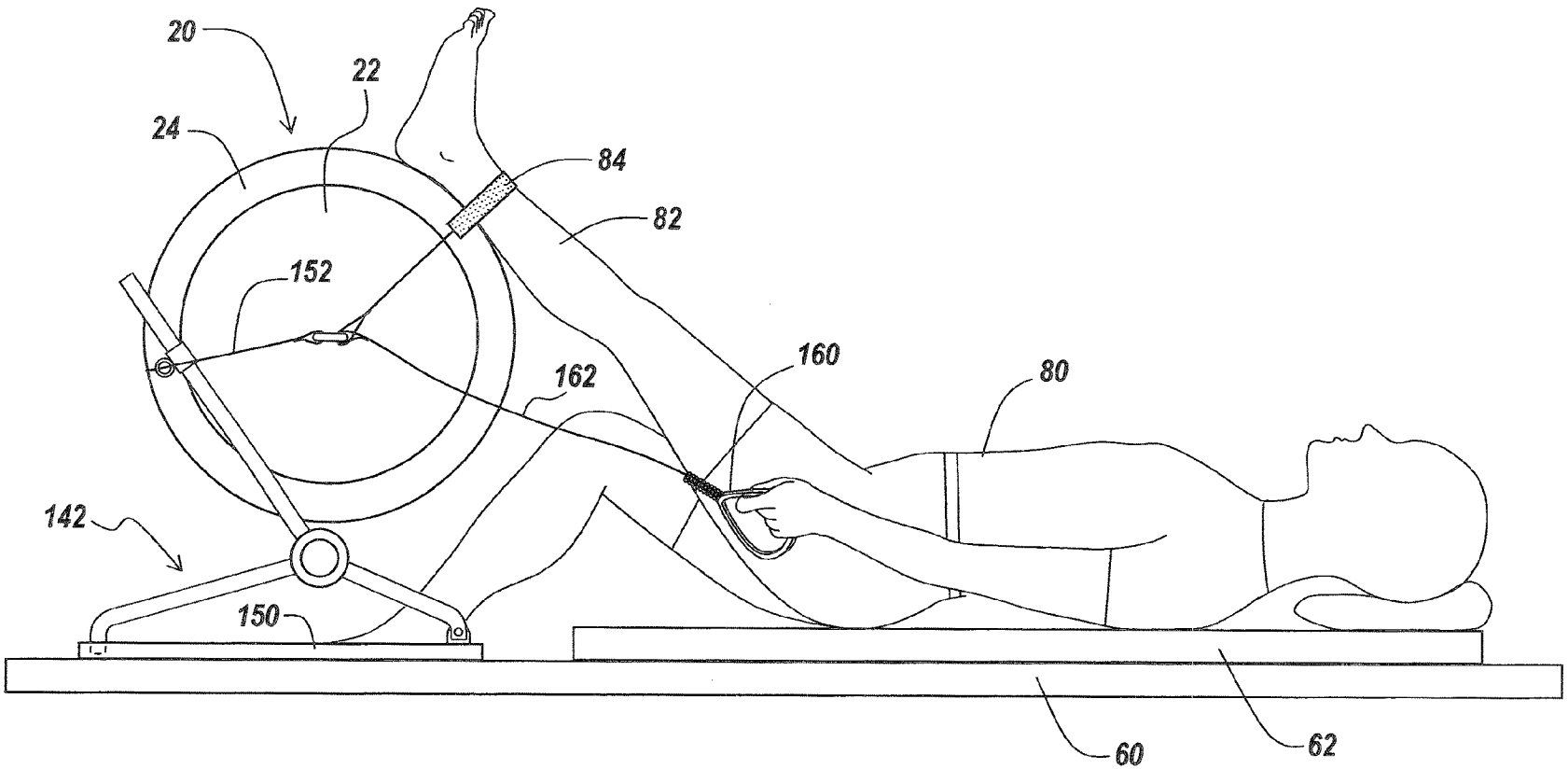
FIG. 15A is an illustration of a user operating the stretching system where the triangular frame holds the stretching device in accordance with one example embodiment of the present invention.
Figure 15B:
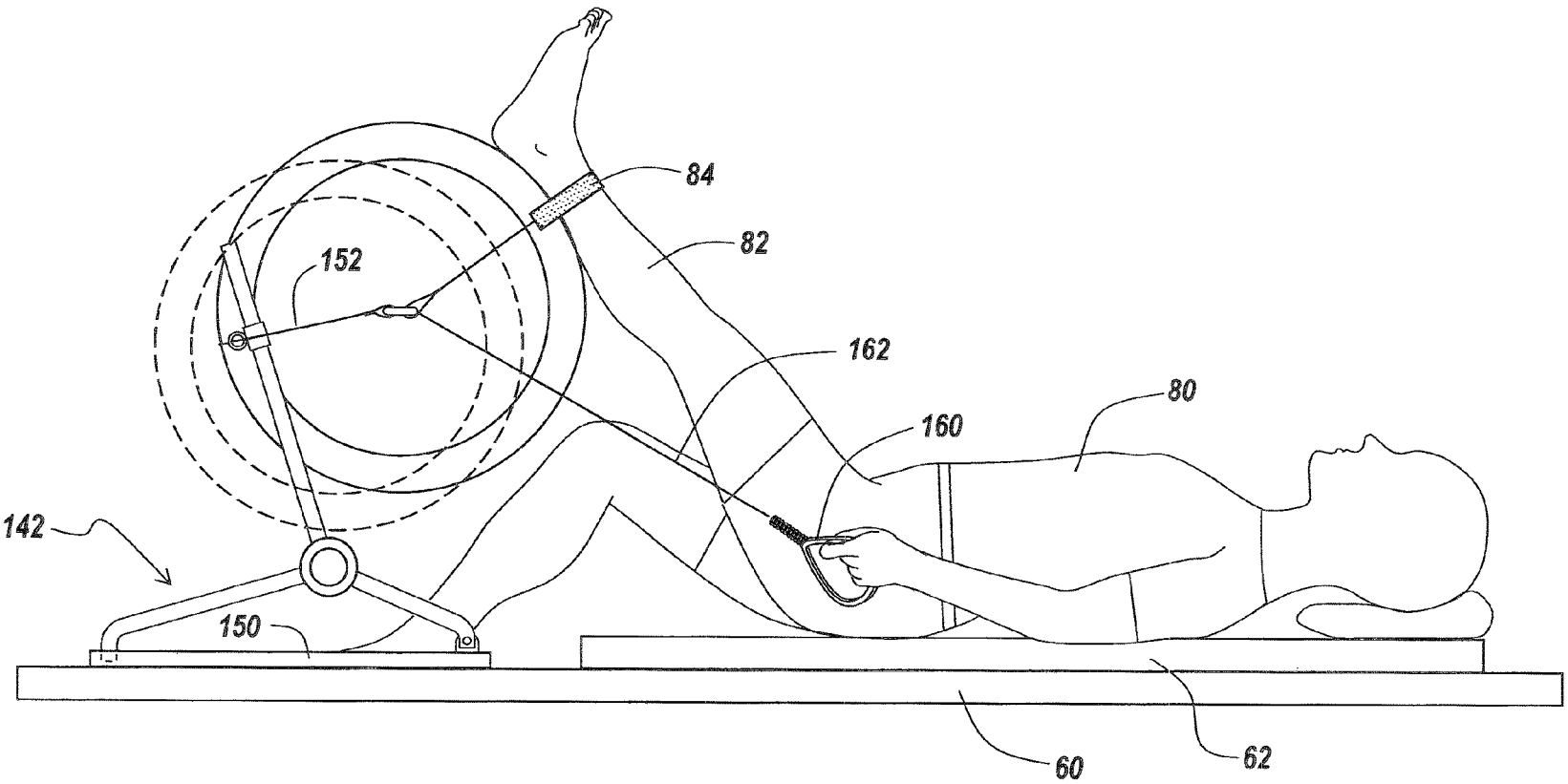
FIG. 15B is an illustration of a user modifying a position of the stretching device with respect to the triangular frame in accordance with one example embodiment of the present invention.

FIGS. 14A-14B further illustrate one or more handles 160 that are attached to the stretching device 20 via one or more cables 162. According to various embodiments of the present invention, the handles 160 may be attached to the triangular frame 142 instead of or as well as the stretching device 20. The one or more handles 160 enable the user 80 to adjust their position with respect to the stretching device 20, as illustrated in FIG. 15A. The one or more handles 160 also enable the user 80 to adjust the position of the stretching device 20 with respect to the triangular frame 142, as further illustrated in FIG. 15B. The user 80 may pull the stretching device 20 toward them by pulling on the handles 160 that are attached to the stretching device 20 through known attachment mechanisms. When the stretching device 20 is pulled toward the user 80, the stretching device 20 may provide increased stretching on the selected body part 82. The stretching device 20 may also include a body part restraint for holding a body part in a static and reproducible position. For example, the body part restraint may include a strap 84 for holding the body part 82 to the stretching device 20.

The stretching system 10 utilizes one or more sources for pressurized air. A portable air compressor can be used to supply the pressurized air. Alternatively, a hand pump can be provided to supply the pressurized air.

Figure 16A:
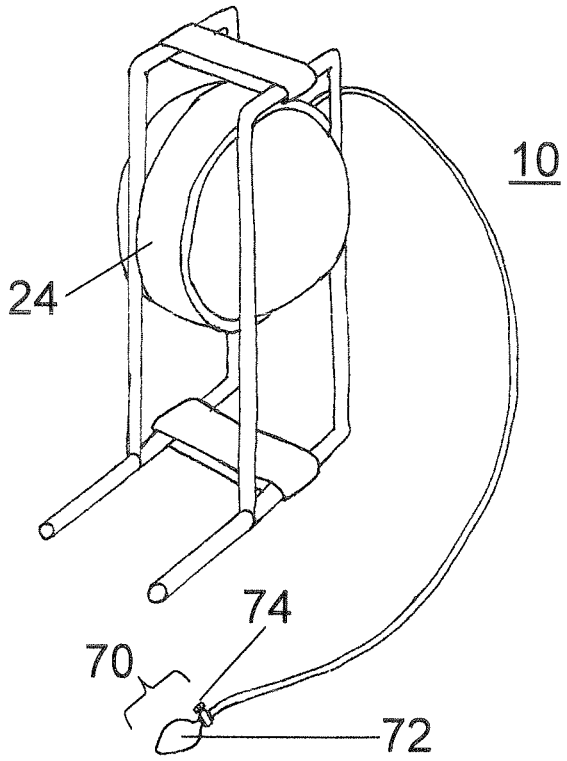
FIG. 16A is an illustration of the stretching system including a control mechanism, in accordance with one example embodiment of the present invention.
Figure 16B:
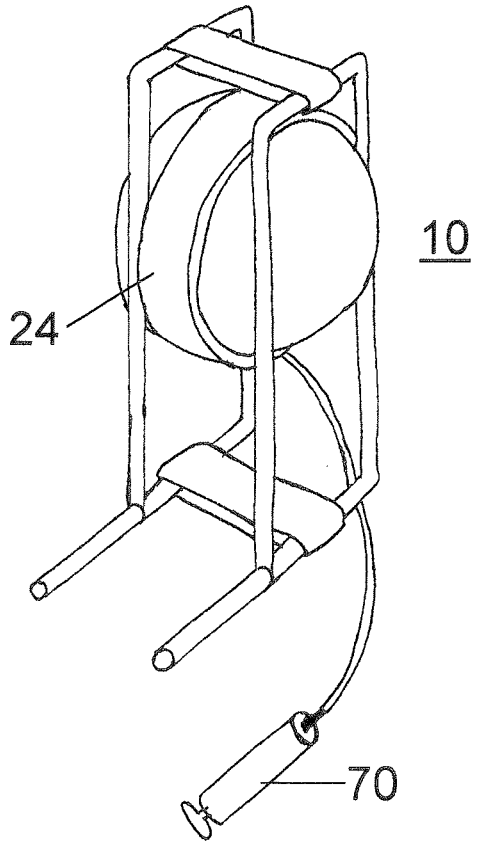
FIG. 16B is an illustration of the stretching system including a control mechanism, in accordance with one example embodiment of the present invention.

The stretching system 10 includes at least a first control mechanism 70 enabling a user 80 to control the amount that at least one of the outer layers is inflated or deflated. The control mechanism may optionally enable a user 80 to control the rate of inflation or deflation. As illustrated in FIG. 16A, the control mechanism 70 may be as simple as a bulb 72 that a user 80 (not illustrated) squeezes to pump air into an outer layer 24 and a release valve 74 to deflate the outer layer 24. Alternatively, as illustrated in FIG. 16B, the control mechanism 70 may include more powerful pumps, such as a hand bicycle pump. Electronics may also be used to enable a user to more easily control sources that generate pressurized air, such as air compressors. One of ordinary skill in the art will appreciate that a number of different control mechanisms are suitable for enabling a user 80 to control the inflation level of parts of the stretching device 20. Additional control mechanisms may be provided for inflating the inner core and/or additional outer layers. Preferably, the user interfaces for all control mechanisms would reside on a single control unit 92.

Figure 17A:
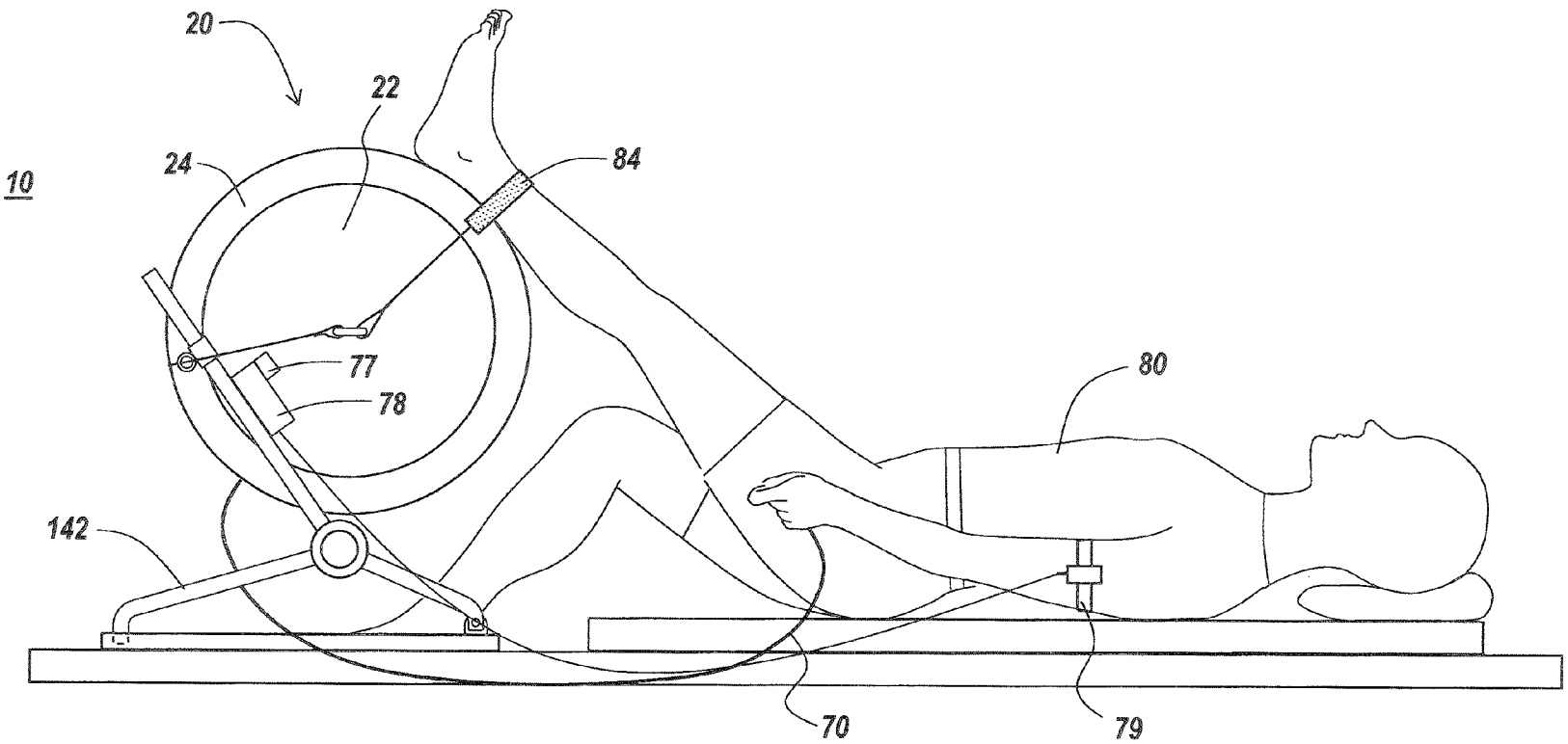
FIG. 17A is an illustration of the stretching system with the triangular frame including a control mechanism, in accordance with one example embodiment of the present invention.

As illustrated in FIG. 17A, the stretching system 10 using the triangular frame 142 may also include the control mechanism 70 enabling the user 80 to control the amount that at least one of the outer layers is inflated or deflated. The control mechanism 70 may optionally enable the user 80 to control the rate of inflation or deflation. The outer layer 24 of the stretching device 20 may be inflated from an initial volume illustrated in FIG. 17A to an increased volume illustrated in FIG. 17B using the control mechanism 70.

The stretching system 10 may also include a biofeedback component that provides information about the effect of the stretching system 10 on a user and/or information about physiological characteristics of the user. The biofeedback component may measure blood pressure, heart rate, skin temperature, muscle tension and the sweat gland activity user. The biofeedback component may compare each measurement to a previously defined target value. If the measurements are above an acceptable level, the biofeedback component may generate one or more audio, visual, tactile signal(s) to notify the user. The biofeedback component may include one or more user modules 79 that are attached to a monitor 78. The one or more user modules 79 may include an electromyograph (EMG) for measuring the muscle tension, a thermometer for measuring the skin temperature, an electrodermograph for measuring activity of sweat glands and/or a photoplethysmograph (PPG) for measuring peripheral blood flow and heart rate. The biofeedback component may also include one or more device modules 77 such as a manometer for measuring the pressure of the stretching device 20 and corresponding force applied to the body part. Those ordinary skill in the art will appreciate that the type and variety of biofeedback components can vary, and that the present invention is not limited to the specific components described herein.

Figure 17B:
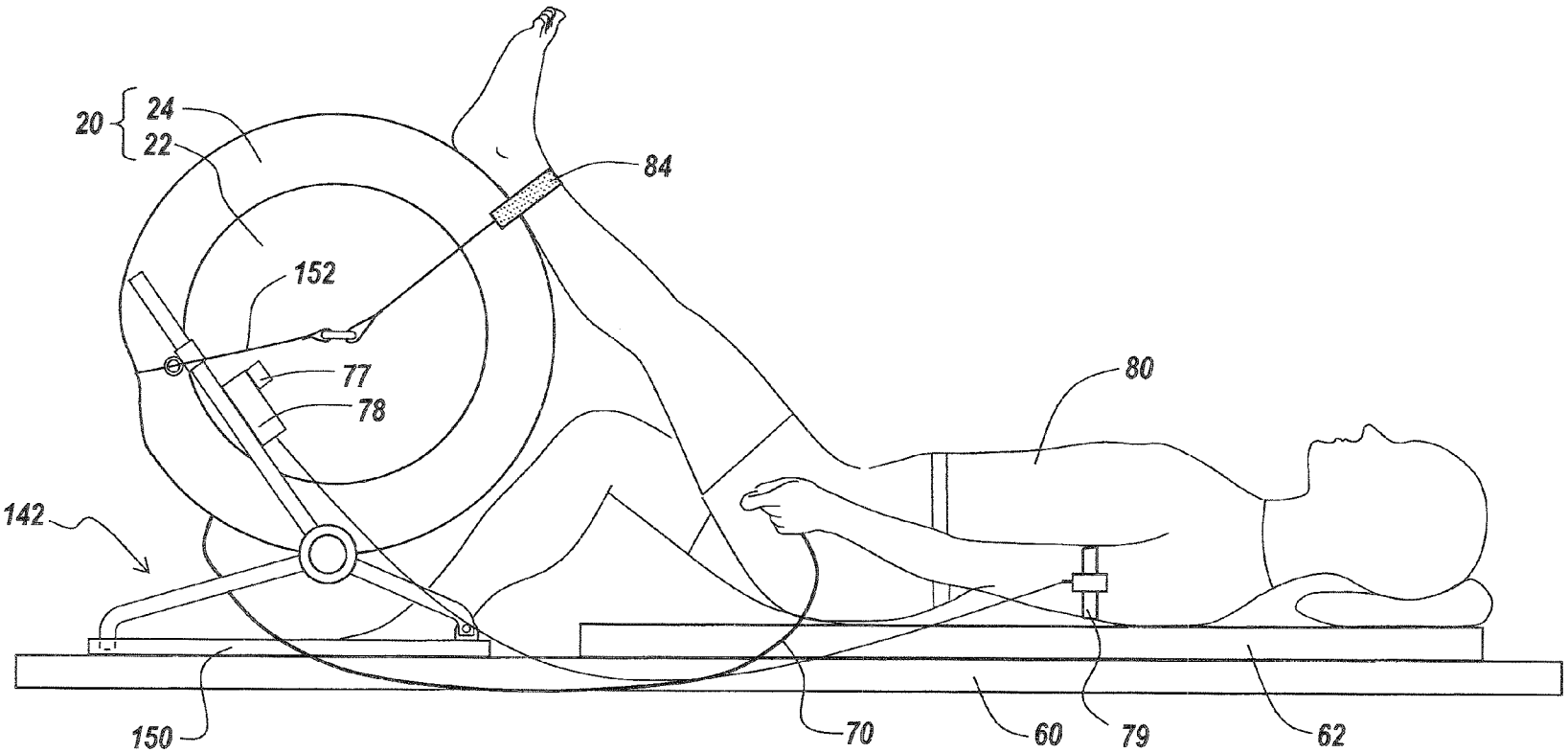
FIG. 17B is an illustration of a user inflating an outer layer of the stretching device held on the triangular frame using the control mechanism, in accordance with one example embodiment of the present invention.
Figure 18:
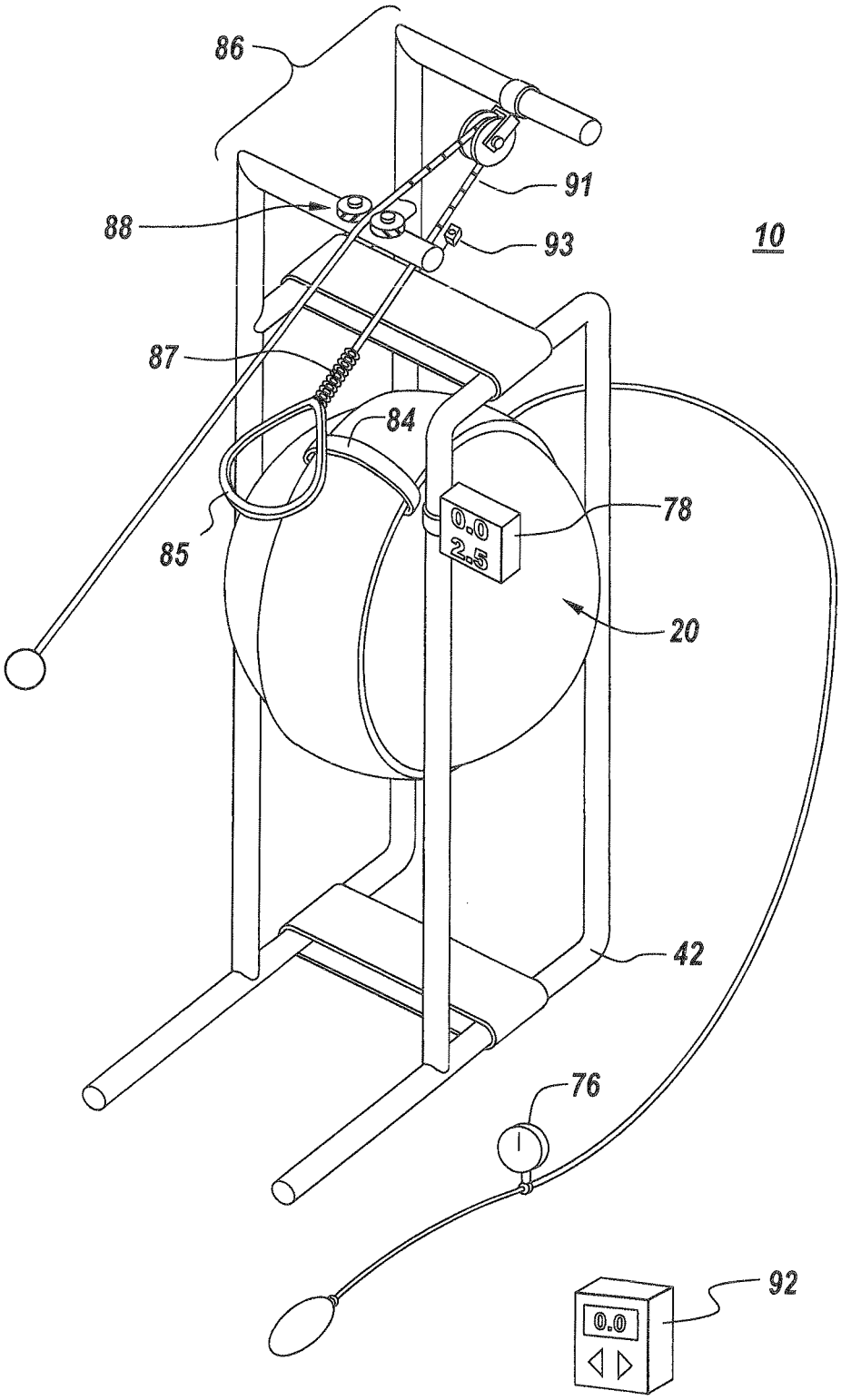
FIG. 18 is an illustration of the stretching system including a biofeedback mechanism, in accordance with one example embodiment of the present invention.

In an example embodiment illustrated in FIG. 18, the biofeedback component includes a pressure measuring device 76, such as a pressure gauge, or manometer, as a device module coupled to the system used to inflate layers of the stretching device 20 in order to measure the pressure being applied to a body part. The biofeedback information provided from the biofeedback component may be displayed remotely from the biofeedback component. For example, the biofeedback information may be displayed on a monitor 78 mounted to the frame 42 or on a remote control unit 92. Alternatively, the biofeedback information may be displayed on a monitor 78 mounted to the triangular frame 142, as illustrated in FIGS. 17A-17B. The biofeedback information may enable the user to control the stretching of the body part by keeping the biological and pressure or force readings within desirable levels. The biofeedback information may also help user to repeat the stretching under same conditions, e.g. stretch the body part to the same extent in each repetition. Therefore, the biofeedback component may prevent under-stretching or over-stretching of the body part.

The stretching system 10 may also include a body part restraint for holding a body part in a static and reproducible position. For example, the body part restraint may include a strap 84 for holding the body part to the stretching device 20. Alternatively, the body part restraint may include a body part sling 85 coupled to the frame 42. For ease of use, mechanisms may be provided to help a user place a body part into the body part restraint. For example, a pulley system 86 with a rope clutch 88 may be provided to enable a user to put the body part into the body part sling 85 when the body part sling 85 is on the ground and then pull the body part sling 85 into the desired position. One of ordinary skill in the art will additionally appreciate different ways to provide a body part restraint that is easy to use without departing from the spirit and scope of the present invention.

An extension measurement device 87 may be coupled to the body part restraint to provide biofeedback about the amount of extension of the body part. As illustrated in FIG. 18, the extension measurement device 87 may include a spring coupled to the body part sling 85 to measure the degree of force exerted on the body part. The force measurement may then be converted to a distance reading for presentation to a user. In another embodiment, the extension measurement device 87 may include marks on a cable 91 and an optical reader 93 to measure the amount of extension by measuring how far the cable has moved. One of ordinary skill in the art will additionally appreciate different ways to measure the extension of the body part without departing from the spirit and scope of the present invention.

The biofeedback mechanisms described herein are not intended to be limiting. Any suitable means known to those of ordinary skill in the art for providing biofeedback may be incorporated into the stretching system 10 without departing from the scope of the invention.

In accordance with one example embodiment of the present invention, as shown in FIGS. 24-27, the stretching system 10 includes a stretching device 20 held at a selected height and orientation by a support 340. The stretching device 20 includes the inner inflatable core and outer inflatable layer combined into a single inflatable component 322 (a single inflatable chamber, not two different inflatable chambers) that when inflated exerts pressure against an object that contacts its surface (such as a leg of a user). The support 340 includes a frame 342 formed from bars 344 that support the stretching device 20 at the desired height and orientation when the inflatable component 322 is inflated. The frame 342 can be formed in accordance with other frame embodiments described herein. The support 340 may also include a platform 330 and post 332. In such an example embodiment a foam core 334 may be provided inside the inflatable component 322 and mounted on the post 332. The foam core 334 is generally smaller in diameter than the inflated inflatable component 322. In accordance with one example embodiment of the present invention, the foam core 334 has a diameter of about 30 inches and the fully inflated inflatable component 322 has a maximum diameter of 80 inches. A sealing ring 350 may compressively hold a base of the inflatable component 322 in place, without leakage, on the platform 330; although, one of ordinary skill in the art will appreciate that other mounting configurations and mechanisms may be utilized, such that the present invention is in not limited by this illustrative mounting embodiment. A valve 364 may also be provided for inflation or deflation of the inflatable component 322.

The support 340 may further have a pressure plate 336 coupled therewith, and connected to a digital gauge 338. The pressure plate 336 has a plurality of sensors 337, e.g., one on each corner and several central sensors 337. The digital gauge 338 registers the amount of pressure that is being applied by a user against the inflatable component 322 when the user is in a stretching position and applying a force against the inflatable component 322. The digital gauge 338 attaches to the pressure plate 336 and enables measurement of the pressure in lbs being applied to the extremity as the inflation component 322 is inflated. The digital gauge 338 can be zeroed with an applied load. This allows a user to first place a limb on the ball. The gauge 338 would then display the weight of the leg. The gauge can then be zeroed with the limb weight on the inflatable component 322 and then inflate the inflatable component 322 and measure only the applied force.

With the use of the pressure plate 336 and the digital gauge 338, the apparatus may be connected to a computing device for data collection and analysis. In addition, the computing device can provide feedback in the form of inflation or deflation of the inflatable component 322 to achieve a desired stretching protocol for a user.

The location of the inflatable component 322 can be adjusted. In the illustrative embodiment of FIGS. 24 & 25 the stretching device 20 further includes a plurality of track rollers 360. The track rollers 360 are rotatably coupled with the inflatable component 322 and are configured to run along the bars 344 of the frame 342, enabling positioning of the inflatable component 322 as desired. A linkage 362, such as a spring loaded braking mechanism, can be provided to lock the platform 330 with the pressure plate 336 and the inflatable component 322 in place. One of ordinary skill in the art will appreciate there are many different mechanical mechanisms for locking objects in place, all of which that may be utilized in an equivalent manner are anticipated for use with the present invention.

Figure 24:
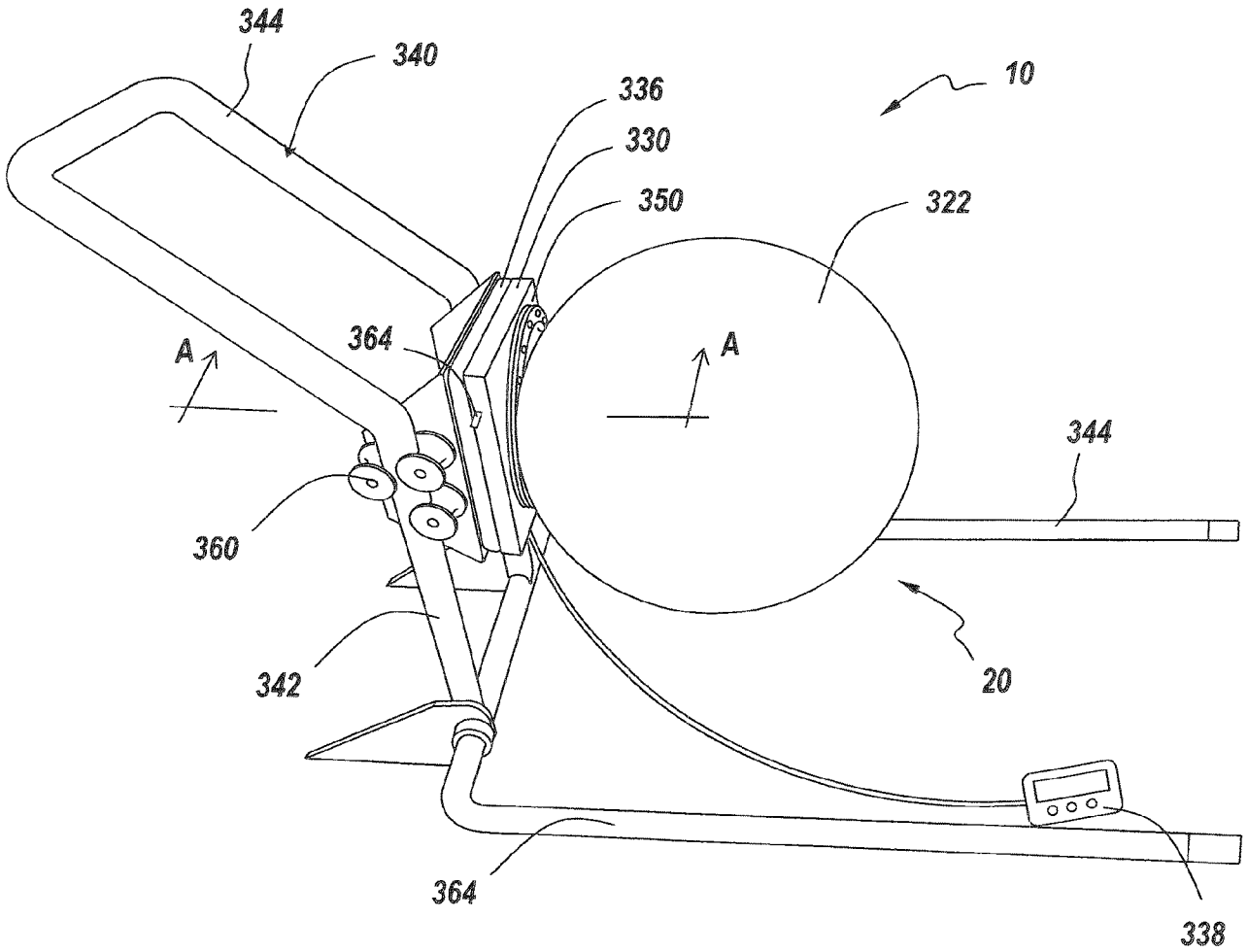
FIG. 24 is a perspective illustration of a stretching system in accordance with one example embodiment of the present invention.
Figure 25:
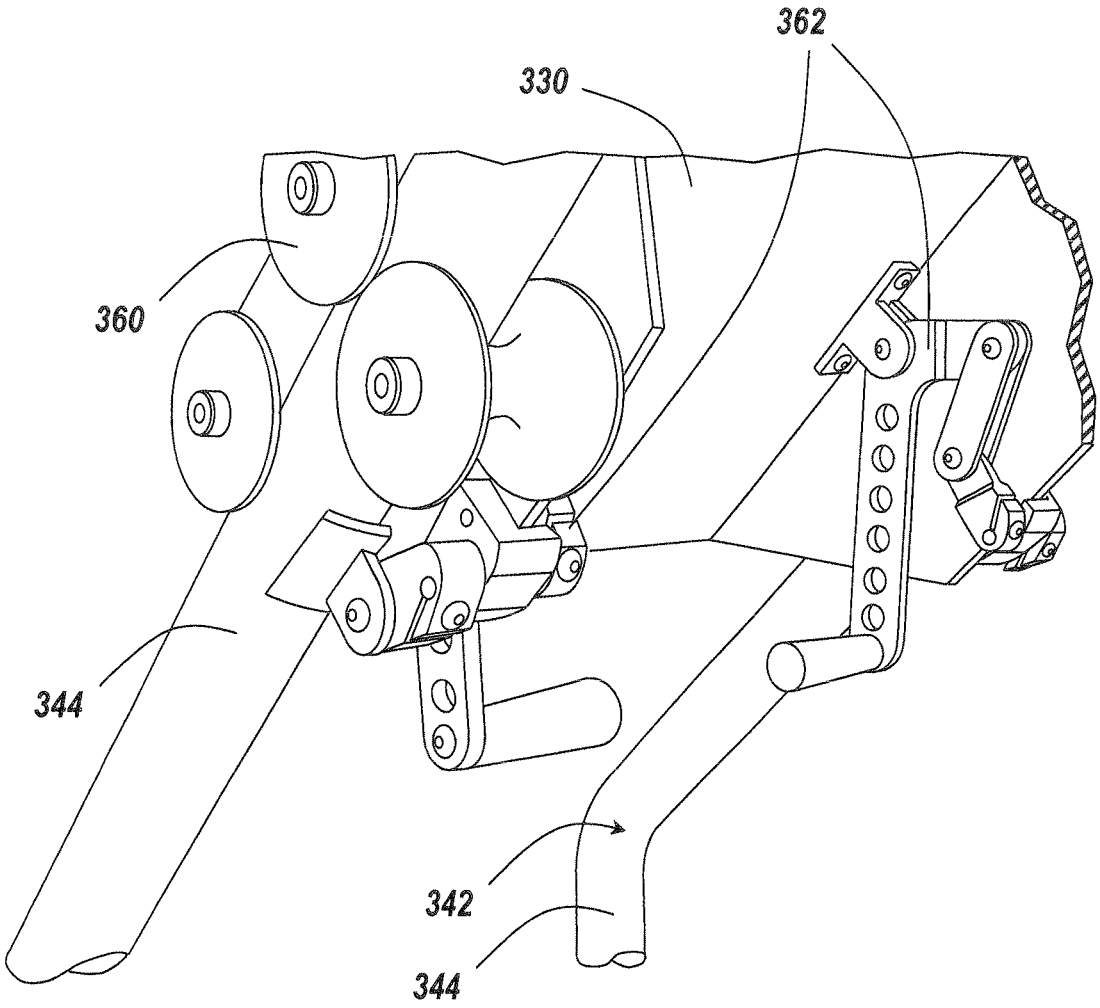
FIG. 25 is a close-up view of a linkage and positioning mechanism of the stretching system in accordance with one embodiment of the present invention.
Figure 26:
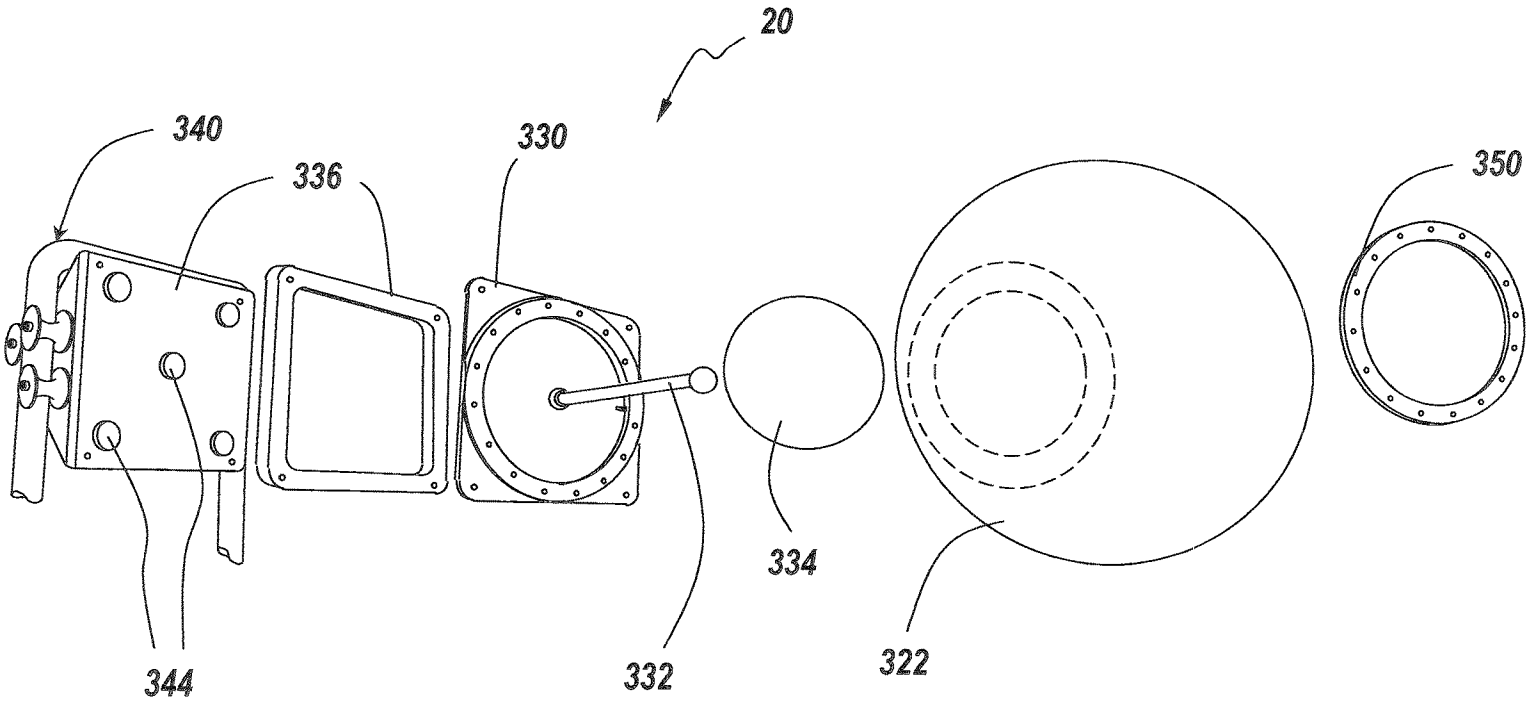
FIG. 26 is an exploded view of the stretching system of FIG. 24, in accordance with one embodiment of the present invention.
Figure 27:
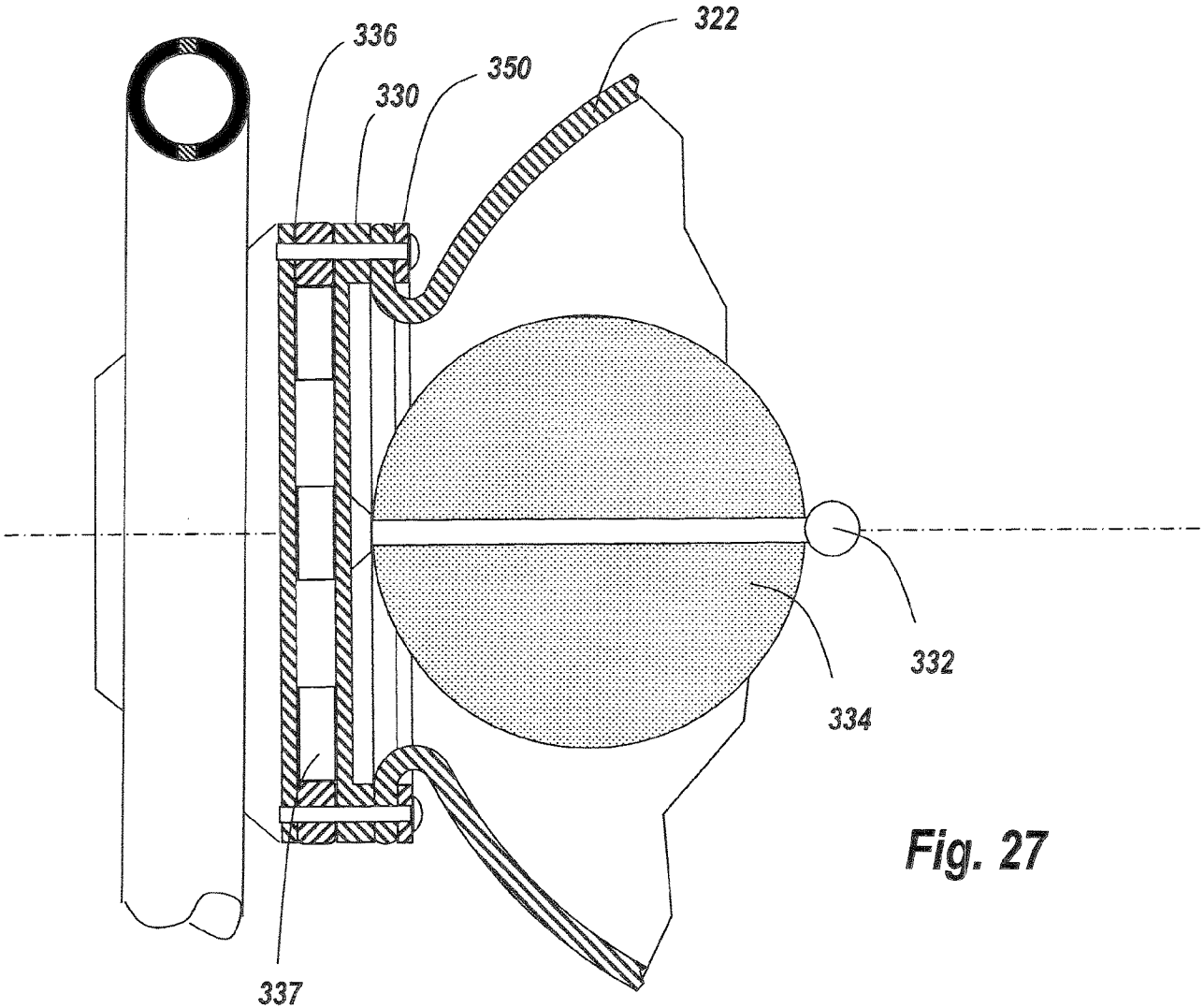
FIG. 27 is a cross-sectional side view of a stretching device portion of the stretching system of FIG. 24, in accordance with one embodiment of the present invention.

The stretching system of the presently discussed embodiment can further include a floor component 364. As illustrated in FIG. 24, the floor component 364 may include a bar on which a user may rest, so that the frame is less likely to move away from the user when the stretching system 10 is used. The floor component 364 is preferably rigidly attached to, or integrally formed with, the frame 342.

As described in other embodiments herein, the stretching system 10 of FIGS. 24-27 may include at least a first control mechanism 70 enabling a user control the amount that at least one of the outer layers is inflated or deflated. The control mechanism 70 may optionally enable a user 80 to control the rate of inflation or deflation. The control mechanism 70 may be as simple as a bulb that a user 80 squeezes to pump air into the inflatable component 322. Alternatively, the control mechanism may include more powerful pumps, such as a hand bicycle pump. Electronics may also be used to enable a user to more easily control sources that generate pressurized air, such as air compressors. One of ordinary skill in the art will appreciate that a number of different control mechanisms are suitable for enabling a user 80 to control the inflation level of parts of the stretching device 20. Additional control mechanisms may be provided for inflating the inflatable component 322. Preferably, the user interfaces for all control mechanisms would reside on a single control unit as described herein.

As likewise described in other embodiments herein, the stretching device 20 of FIGS. 24-27 may further include a biofeedback component for displaying biofeedback information. For example, the biofeedback information may be displayed on a monitor mounted to the frame 342 or on a remote control unit. Alternatively, the biofeedback information may be displayed on a monitor mounted to the frame 342, as illustrated in FIGS. 17A-17B. The biofeedback information may enable the user to control the stretching of the body part by keeping the biological and pressure or force readings within desirable levels. The biofeedback information may also help user to repeat the stretching under same conditions, e.g. stretch the body part to the same extent in each repetition. Therefore, the biofeedback component may prevent under-stretching or over-stretching of the body part.

It should be noted that the difference in the structure of the frame 342 and the inflatable component 322 of the present embodiment does not alter the ability of accessories described herein throughout to be utilized in conjunction with the stretching device 20 of FIGS. 24-27. As such further detail is provided herein throughout the present description for any accessories not specifically illustrated, or described, in the context of the embodiment of FIGS. 24-27, but they are nonetheless anticipated for use with said embodiment as with other embodiments herein.

Figure 19:
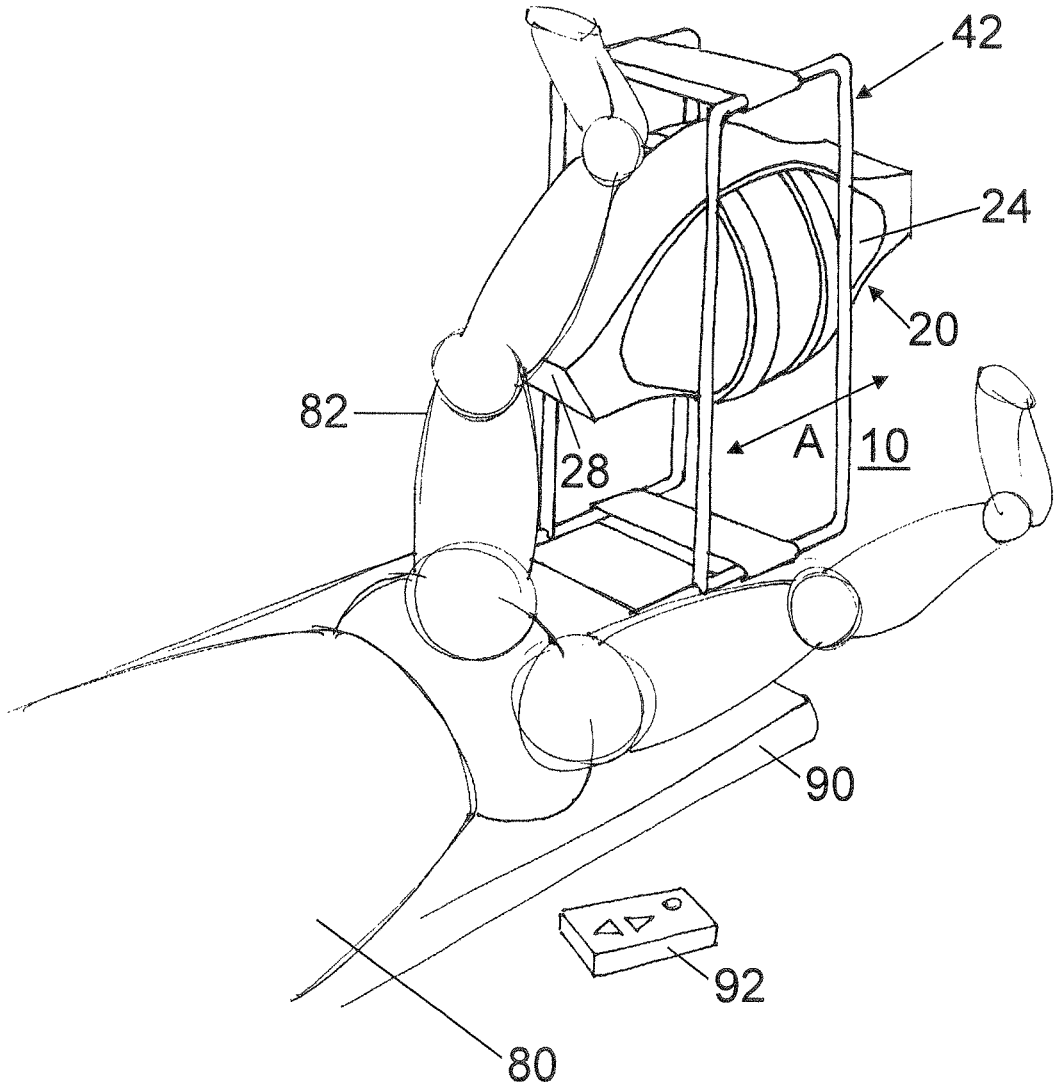
FIG. 19 is an illustration of a user operating the stretching system in accordance with one example embodiment of the present invention.

In operation, a user 80 first determines which body part is to be stretched. FIG. 19 illustrates the use of the stretching system 10 to stretch a body part 82 (shown as a user's leg). The proper height and orientation of the stretching device 20 (see also FIGS. 24-27) is determined based on the height and orientation of the body part 82 and the inner core 22 (not illustrated) is inflated to hold the stretching device in the frame 42 at the desired height and orientation. The user 80 rests the body part 82 on the stretching device 20 so that the user contact surface 28, if there is a defined one, faces a portion of the body part 82 against which pressure is desired. A mat 90 may be placed across the floor component 60 (not illustrated) to increase the comfort of the user. The user 80 then initiates the passive stretch by inflating at least one of the outer layers 24 (e.g., as shown in FIGS. 16A-17B) using a control mechanism 70, preferably through the use of a control unit 92. When the one or more outer layers 24 inflate in a stretching direction A, the user contact surface 28 and/or outer surface of the outer layer 24 push against the resting body part 82, thereby passively stretching the muscles of body part 82. Because the user 80 may easily control the degree of inflation of the outer layer(s) 24, the user may stop the inflation when the muscles are stretched and may hold the muscles in a stretched position for some time before either increasing the amount of stretch or decreasing the amount of stretch.

Because the stretching device 20 may be positioned at any height along the frame 42 or the triangular frame 142 of the support 40 and may be oriented in any direction, the stretching system 10 is able to apply pressure in any of the three planes. Other devices only apply pressure in a single plane.

Figure 20:
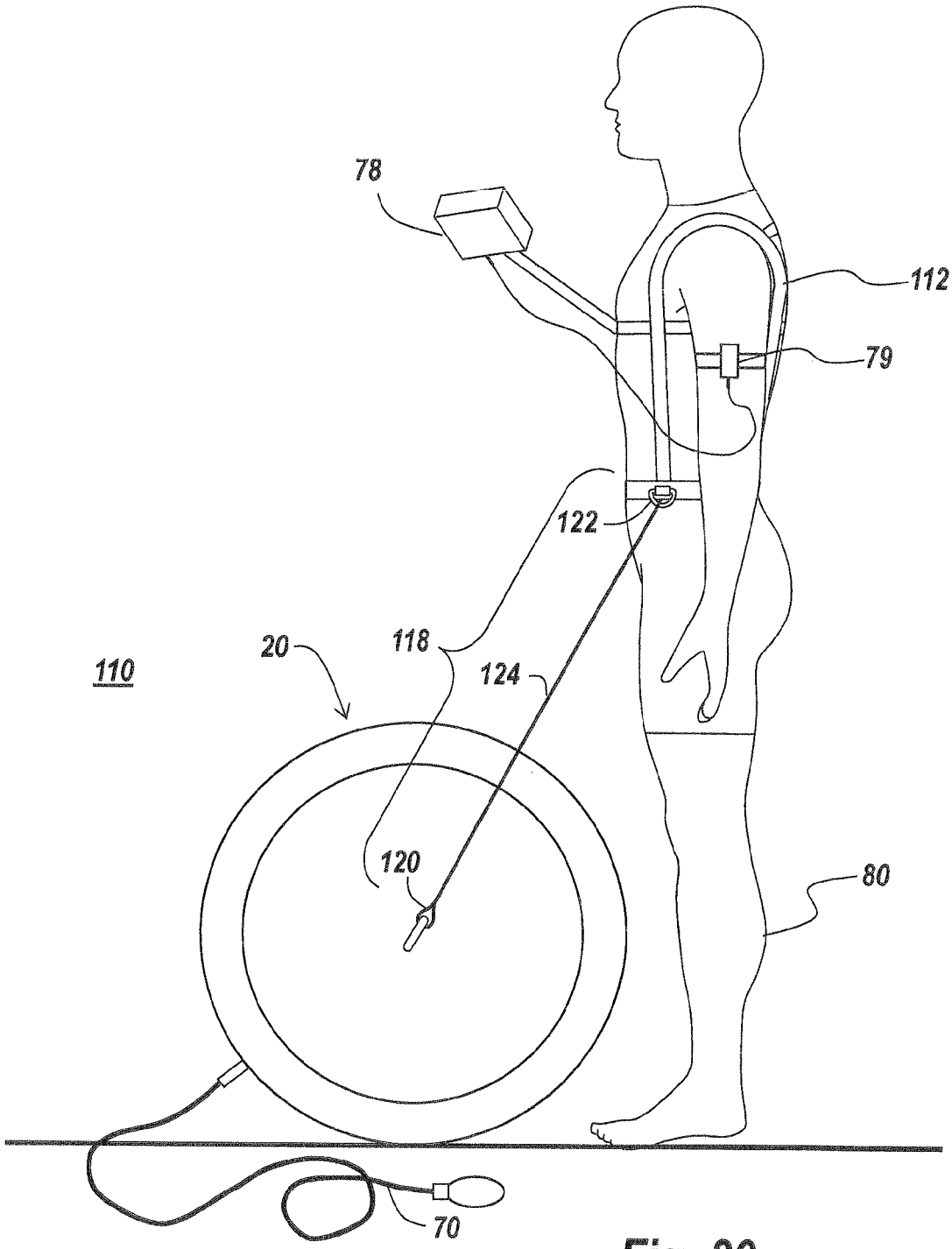
FIG. 20 is an illustration of a portable stretching system in accordance with one example embodiment of the present invention.

In an example embodiment illustrated in FIG. 20, the stretching system 10 may be made portable. The portable stretching system 110 includes a harness 112 that is worn by the user 80 and the stretching device 20 that is coupled to the harness 112 via an attachment mechanism 118. The attachment mechanism 118 may include device attachment means 120 and user attachment means 122 that are connected to each other via one or more cords 124. One of ordinary skill in the art will additionally appreciate different ways to attach the stretching device 20 to the harness 122 without departing from the spirit and scope of the present invention. The portable stretching system 110 may include a monitor 78 mounted to the harness 112 and connected to a user biofeedback module 79 for providing biofeedback information to the user 80, as illustrated in FIG. 20.

Figure 21:
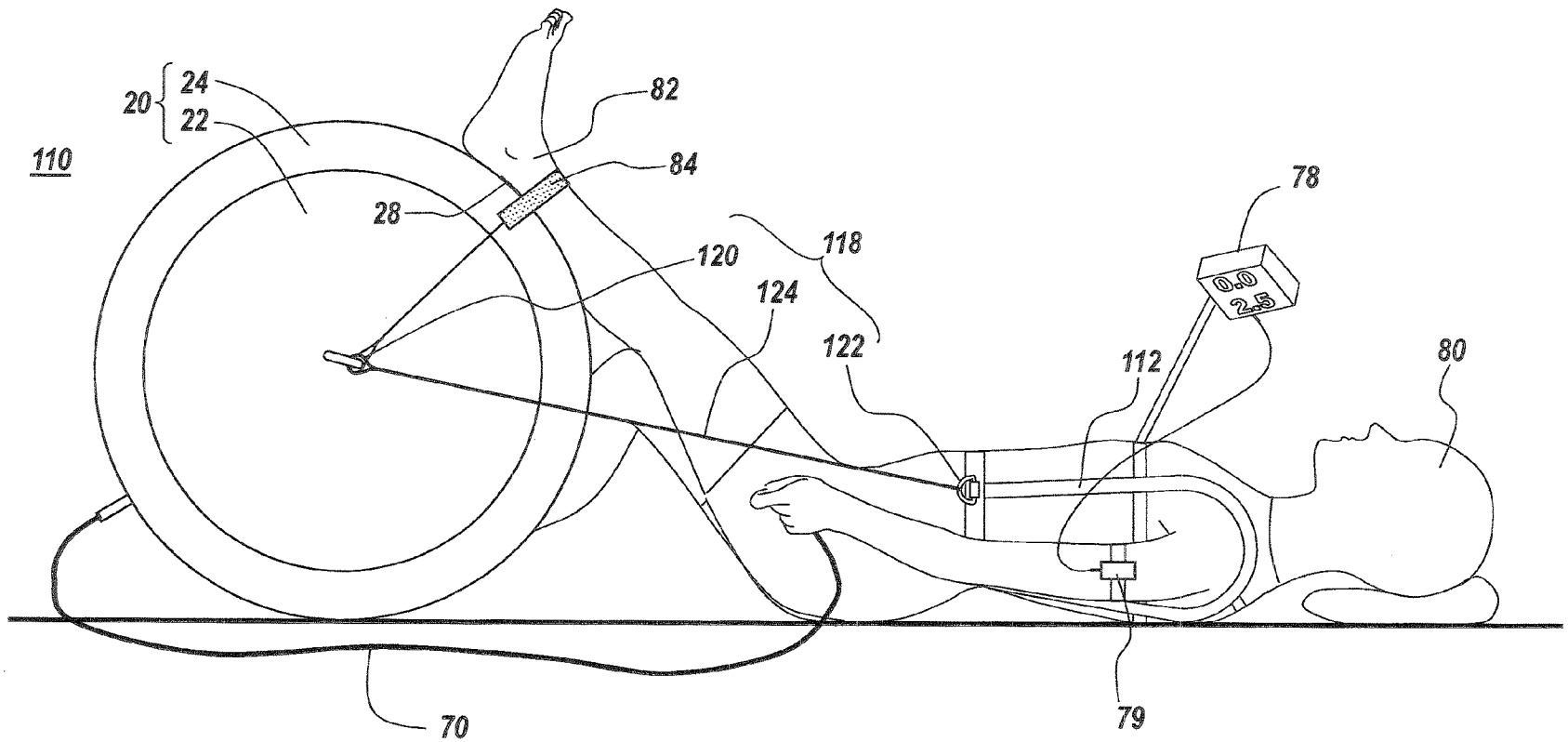
FIG. 21 is an illustration of a user operating the portable stretching system in accordance with one example embodiment of the present invention.
Figure 22:
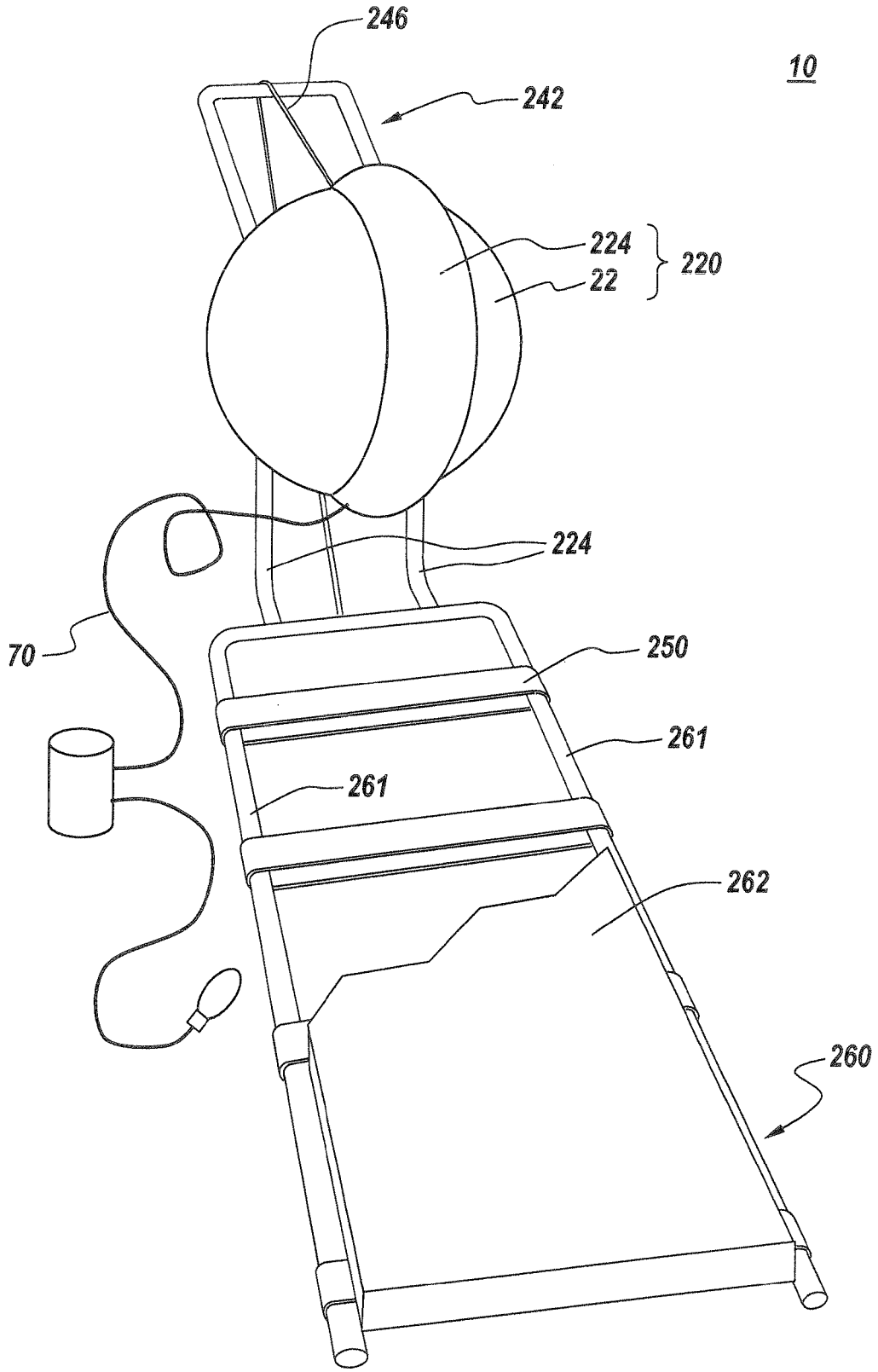
FIG. 22 is a perspective illustration of a stretching system in accordance with one example embodiment of the present invention.
Figure 23:
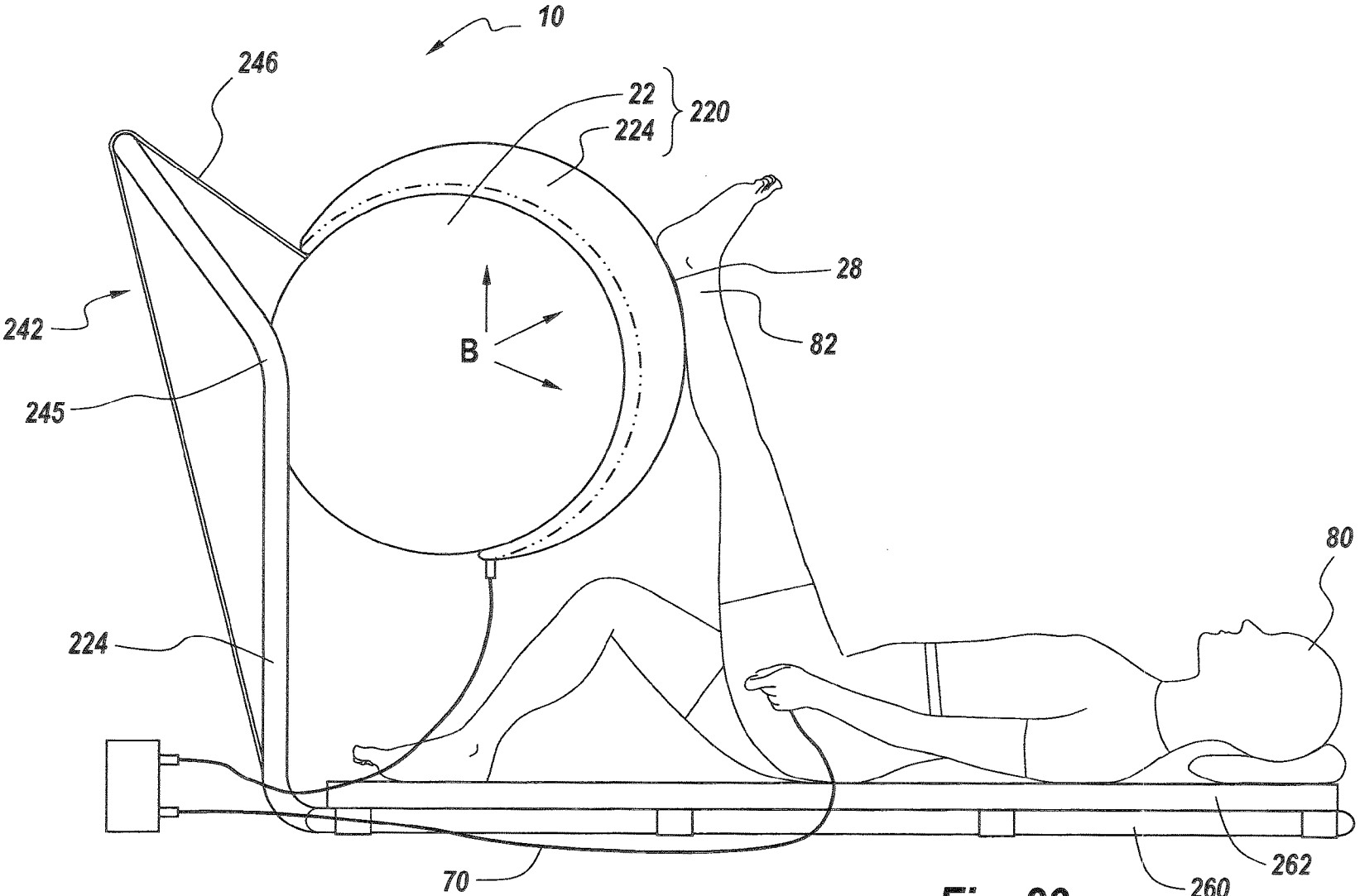
FIG. 23 is an illustration of a user operation the stretching system as depicted in FIG. 22, in accordance with one example embodiment of the present invention.

FIG. 21 illustrates the use of the portable stretching system 110 to stretch a body part 82 (shown as a user's leg). The user 80 may adjust the horizontal placement of the stretching device 20, for example, by pulling the one or more cords 124. The user 80 may use body parts to stabilize the stretching device 20. For example, as illustrated in FIG. 21, the user 80 stretches the left leg and uses the right leg to stabilize the stretching device 20. Alternatively, the strap 84 may stabilize the body part on the stretching device 20. For stretching, the user 80 rests the body part 82 on the stretching device 20 so that the user contact surface 28 faces a portion of the body part 82 against which pressure is desired. The user 80 then initiates the passive stretch by inflating at least one of the outer layers 24 using a control mechanism 70. When the one or more outer layers 24 inflate, the user contact surface 28 and/or outer surface of the outer layer 24 push against the resting body part 82, thereby passively stretching the muscles of body part 82. Because the user 80 may easily control the degree of inflation of the outer layer(s) 24, the user may stop the inflation when the muscles are stretched and may hold the muscles in a stretched position for some time before either increasing the amount of stretch or decreasing the amount of stretch. The user may also control the degree of inflation of the outer layer(s) 24.

Preferably, the stretching system 10 is made of materials so that it may be completely submersible. The source of pressured air, however, may be located outside of the wet area in which the stretching system 10 is used.

With the present invention, a user may engage in a regular regime of passive stretching exercises without relying on the assistance of another person. If the stretching system 10 is submersible, passive stretching exercises may be performed in a wet environments such as a shower, bath tub, pool, or sauna. If the stretching system 10 is easily disassembled or collapsible, then the stretching system 10 may be brought along while traveling to maintain the continuity of one's passive stretching exercise regime.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A system, comprising:

a stretching device, the stretching device comprising an inflatable component affixed to a moveable platform, wherein the inflatable component is configured to apply force against a limb of a user placed thereon;

a support supporting the stretching device, the stretching device being adjustably coupled to the support in such a way that the stretching device can be positionally adjusted along the support and fixed in a desired, user-defined location;

a first control mechanism enabling a user to control the degree of inflation of the inflatable component; and at least one user contact surface removably attached to the inflatable component, wherein the user contact surface is positionally adjustable.

2. The system of claim 1, wherein the inflatable component comprises an inflatable inner core and an inflatable outer layer.

3. The system of claim 1, further comprising a second control mechanism enabling the user to control the degree of inflation of the inflatable component.

4. The system of claim 1, wherein the at least one user contact surface is formed from a solid foam.

5. The system of claim 1, wherein the moveable platform further comprises a pressure plate mounted thereon in such a way that pressure applied to the inflatable component impacts and is measurable by the pressure plate.

6. The system of claim 5, wherein the pressure plate comprises a plurality of sensors that are configured to measure a force applied to the pressure plate.

7. The system of claim 1, further comprising one or more mechanical fasteners configured to position or bind a limb of a user relative to the stretching device.

8. The system of claim 1, further comprising a floor component coupled to the support, the floor component stabilizing the support when the system is in use.

9. The system of claim 1, wherein the system is portable.

10. The system of claim 1, wherein the system is waterproof and submergible.

11. The system of claim 1, further comprising a biofeedback component including one or more user modules coupled to the user and one or more stretching device modules coupled to the stretching device, wherein the biofeedback component provides contemporaneous biological information to the user.

12. The system of claim 11, wherein the one or more stretching device modules include a pressure sensor coupled to the stretching device to measure force applied to a body part in contact with the stretching device.

13. The system of claim 1, wherein the support comprises at least two bars, the stretching device being adjustably coupled to the support between the at least two bars in such a way that the stretching device can be positionally adjusted along the at least two bars and fixed in a desired, user-defined location along the at least two bars.

14. A method of using a device to assist in stretching a limb, the method comprising:

positioning an inflatable stretching device along a supportive frame in such a way as to be located in a desired, user-defined position for implementation of a passive stretch of a limb of a user;

placing the limb of the user against the stretching device; and activating inflation of the inflatable stretching device in such a way that a passive stretch of the limb is achieved.

15. The method of claim 14, further comprising measuring a pressure placed against the inflatable stretching device.

16. The method of claim 14, further comprising controlling an amount of inflation of the inflatable stretching device based at least in part on a measurement of pressure placed against the inflatable stretching device by the limb of the user.

17. The method of claim 14, wherein the supportive frame comprises at least two bars, the stretching device being adjustably coupled to the supportive frame between the at least two bars in such a way that the stretching device can be positionally adjusted along the at least two bars and fixed in a desired location along the at least two bars.

* * * * *